US008568203B2

(12) United States Patent
Sato et al.

(10) Patent No.: US 8,568,203 B2
(45) Date of Patent: Oct. 29, 2013

(54) METHOD AND APPARATUS FOR MULTIPLE CUTOFF MACHINING OF RARE EARTH MAGNET BLOCK, CUTTING FLUID FEED NOZZLE, AND MAGNET BLOCK SECURING JIG

(75) Inventors: Koji Sato, Echizen (JP); Takehisa Minowa, Echizen (JP); Takaharu Yamaguchi, Echizen (JP); Takayuki Hasegawa, Echizen (JP); Kazuhito Akada, Echizen (JP)

(73) Assignee: Shin-Etsu Chemical Co., Ltd., Tokyo (JP)

( * ) Notice: Subject to any disclaimer, the term of this patent is extended or adjusted under 35 U.S.C. 154(b) by 628 days.

(21) Appl. No.: 12/609,849

(22) Filed: Oct. 30, 2009

(65) Prior Publication Data

US 2010/0112904 A1 May 6, 2010

(30) Foreign Application Priority Data

Nov. 5, 2008 (JP) ..... 2008-284566
Nov. 5, 2008 (JP) ..... 2008-284644
Nov. 5, 2008 (JP) ..... 2008-284661

(51) Int. Cl.
*B24B 1/00* (2006.01)

(52) U.S. Cl.
USPC ..... 451/53; 451/60; 125/13.01

(58) Field of Classification Search
USPC ..... 451/53, 60; 125/13.01, 17, 20
See application file for complete search history.

(56) References Cited

U.S. PATENT DOCUMENTS 2,511,962 A * 6/1950 Barnes ..... 451/41
3,848,929 A 11/1974 Miller
4,635,513 A * 1/1987 McGeehee ..... 83/169
4,848,200 A * 7/1989 McGehee ..... 83/169
6,012,977 A * 1/2000 Yoshikawa et al. ..... 451/541
6,386,948 B1 * 5/2002 Kondo ..... 451/28
6,463,920 B1 * 10/2002 Kondo et al. ..... 125/15
6,517,427 B1 * 2/2003 Yoshikawa et al. ..... 451/547

(Continued)

FOREIGN PATENT DOCUMENTS

JP 50-35933 A 4/1975
JP 54-139182 A 10/1979

(Continued)

OTHER PUBLICATIONS

Shinichi Ninomiya, et al., "Development of a New Coolant Supplying Nozzle for a Thin Blade for Reducing Coolant Supply," Journal of Japan Society of Precision Engineering, 2007, pp. 786-791, vol. 73, No. 7.

(Continued)

*Primary Examiner* — Maurina Rachuba
(74) *Attorney, Agent, or Firm* — Westerman, Hattori, Daniels & Adrian, LLP

(57) ABSTRACT

In a method for multiple cutoff machining a rare earth magnet block, a cutting fluid feed nozzle having a plurality of slits is combined with a plurality of cutoff abrasive blades coaxially mounted on a rotating shaft, each said blade comprising a base disk and a peripheral cutting part. The slits in the feed nozzle into which the outer peripheral portions of cutoff abrasive blades are inserted serve to restrict any axial run-out of the cutoff abrasive blades during rotation. Cutting fluid is fed from the feed nozzle through slits to the rotating cutoff abrasive blades and eventually to points of cutoff machining on the magnet block.

12 Claims, 11 Drawing Sheets

(56) References Cited

U.S. PATENT DOCUMENTS

| | | | | |
|---|---|---|---|---|
| 6,595,094 | B1 | 7/2003 | Kondo et al. | |
| 6,889,586 | B2 * | 5/2005 | Kondo et al. | 125/13.01 |
| 7,040,969 | B1 * | 5/2006 | Chikuba et al. | 451/57 |
| 7,281,535 | B2 | 10/2007 | Mihai et al. | |
| 2011/0162504 | A1 * | 7/2011 | Doi et al. | 83/676 |
| 2011/0165822 | A1 * | 7/2011 | Doi et al. | 451/28 |
| 2011/0312255 | A1 * | 12/2011 | Akada et al. | 451/57 |

FOREIGN PATENT DOCUMENTS

| | | | |
|---|---|---|---|
| JP | 63-156710 | U | 10/1988 |
| JP | 02-071973 | A | 3/1990 |
| JP | 2-56562 | U | 4/1990 |
| JP | 2-71973 | A | 12/1990 |
| JP | 3-190663 | A | 8/1991 |
| JP | 05-092420 | A | 4/1993 |
| JP | 6-304833 | A | 11/1994 |
| JP | 07-171765 | A | 7/1995 |
| JP | 9-174441 | A | 7/1997 |
| JP | 10-146761 | A | 6/1998 |
| JP | 10-175172 | A | 6/1998 |
| JP | 2000-280160 | A | 10/2000 |
| JP | 2000-355014 | A | 12/2000 |
| JP | 2001-47363 | A | 2/2001 |
| JP | 2001-212730 | A | 8/2001 |
| JP | 2003-326464 | A | 11/2003 |
| JP | 2005-313305 | A | 11/2005 |
| JP | 2006-68998 | A | 3/2006 |
| JP | 2007-044806 | A | 2/2007 |
| JP | 2007-522949 | A | 8/2007 |
| JP | 2007-227594 | A | 9/2007 |
| WO | 2005/080059 | A1 | 9/2005 |
| WO | 2005/082588 | A2 | 9/2005 |

OTHER PUBLICATIONS

Invitation to Respond to Written Opinion dated Nov. 30, 2010, issued in corresponding Singapore Patent Application No. 200907332-1.

Japanese Office Action dated Dec. 5, 2012, issued in corresponding Japanese patent application No. 2008-284661.

Japanese Office Action dated Oct. 24, 2012, issued in corresponding Japanese patent application No. 2008-284566.

Extended European Search Report dated Nov. 9, 2012, issued in corresponding European patent application No. 09252552.6.

Japanese Office Action mailed Sep. 12, 2012, issued in corresponding Japanese patent application No. 2008-284661.

Japanese Office Action dated Sep. 26, 2012, issued in corresponding Japanese Patent Application No. 2008-284644, (3 pages).

Japanese Office Action dated Sep. 12, 2012, issued in corresponding Japanese Patent Application No. 2008-284661, English translation Only (3 pages).

Japanese Office Action dated Sep. 26, 2012, issued in corresponding Japanese Patent Application No. 2008-284644, English translation Only (3 pages).

Suzuki, K. et al, "Development of a New Coolant Supply Method with a Flexible Fluid Guide Sheet," Proceedings of the 2004 Autumn Meeting of the Japan Society for Precision Engineering, 2004, pp. 105-106.

Japanese Office Action dated Jul. 9, 2013, issued in corresponding Japanese Patent Application No. 2008-284644.

US Office Action dated Jul. 22, 2013, issued in U.S. Appl. No. 13/554,363.

US Notice of Allowance dated Jul. 3, 2013, issued in U.S. Appl. No. 13/554,312.

Japanese Court Hearing Appeal No. 2013-7710 dated Jul. 8, 2013, issued in corresponding Japanese Application No. 2008-284644 (w/ English Translation).

U.S. Office Action mailed Sep. 18, 2013, issued in corresponding U.S. Appl. No. 13/754,416.

* cited by examiner

METHOD AND APPARATUS FOR MULTIPLE CUTOFF MACHINING OF RARE EARTH MAGNET BLOCK, CUTTING FLUID FEED NOZZLE, AND MAGNET BLOCK SECURING JIG

CROSS-REFERENCE TO RELATED APPLICATION

This non-provisional application claims priority under 35 U.S.C.§119(a) on Patent Application Nos. 2008-284566, 2008-284644 and 2008-284661 filed in Japan on Nov. 5, 2008, Nov. 5, 2008 and Nov. 5, 2008, respectively, the entire contents of which are hereby incorporated by reference.

TECHNICAL FIELD

This invention generally relates to a multiple blade assembly comprising a plurality of outer-diameter blades for multiple cutoff machining of a rare earth magnet block. More particularly, it relates to a method for multiple cutoff machining of a magnet block, a feed nozzle for feeding cutting fluid to the multiple blade assembly, a jig for fixedly securing the magnet block during machining by the multiple blade assembly, and an apparatus comprising such units.

BACKGROUND ART

Systems for manufacturing commercial products of rare earth magnet include a single part system wherein a part of substantially the same shape as the product is produced at the stage of press molding, and a multiple part system wherein once a large block is molded, it is divided into a plurality of parts by machining. These systems are schematically illustrated in FIG. 1. FIG. 1*a* illustrates the single part system including press molding, sintering or heat treating, and finishing steps. A molded part 101, a sintered or heat treated part 102, and a finished part (or product) 103 are substantially identical in shape and size. Insofar as normal sintering is performed, a sintered part of near net shape is obtained, and the load of the finishing step is relatively low. However, when it is desired to manufacture parts of small size or parts having a reduced thickness in magnetization direction, the sequence of press molding and sintering is difficult to form sintered parts of normal shape, leading to a lowering of manufacturing yield, and at worst, such parts cannot be formed.

In contrast, the multiple part system illustrated in FIG. 1*b* eliminates the above-mentioned problems and allows press molding and sintering or heat treating steps to be performed with high productivity and versatility. It now becomes the mainstream of rare earth magnet manufacture. In the multiple part system, a molded block 101 and a sintered or heat treated block 102 are substantially identical in shape and size, but the subsequent finishing step requires cutting. It is the key for manufacture of finished parts 103 how to cutoff machine the block in the most efficient and least wasteful manner.

Tools for cutting rare earth magnet blocks include two types, a diamond grinding wheel inner-diameter (ID) blade having diamond grits bonded to an inner periphery of a thin doughnut-shaped disk, and a diamond grinding wheel outer-diameter (OD) blade having diamond grits bonded to an outer periphery of a thin disk as a core. Nowadays the cutoff machining technology using OD blades becomes the mainstream, especially from the aspect of productivity. The machining technology using ID blades is low in productivity because of a single blade cutting mode. In the case of OD blade, multiple cutting is possible. FIG. 2 illustrates an exemplary multiple blade assembly 1 comprising a plurality of cutoff abrasive blades 11 coaxially mounted on a rotating shaft 12 alternately with spacers (not shown), each blade 11 comprising a core 11*b* in the form of a thin doughnut disk and an abrasive grain layer 11*a* on an outer peripheral rim of the core 11*b*. This multiple blade assembly 1 is capable of multiple cutoff machining, that is, to machine a block into a plurality of parts at a time.

For the manufacture of OD abrasive blades, diamond grains are generally bonded by three typical binding systems including resin bonding with resin binders, metal bonding with metal binders, and electroplating. These cutoff abrasive blades are often used in cutting off of rare earth magnet blocks.

When cutoff abrasive blades are used to machine a rare earth magnet block of certain size into a plurality of parts, the relationship of the cutting part (axial) width of the cutoff blade is crucially correlated to the material yield of the workpiece (magnet block). It is important to maximize a material yield and productivity by using a cutting part with a minimal thickness, machining at a high accuracy to minimize a machining allowance and cutting sludge, and increasing the number of parts available.

In order to form a cutting part with a minimal width (or thinner cutting part) from the standpoint of material yield, the cutoff wheel core must be thin. In the case of OD blade 11 shown in FIG. 2, its core 11*b* is usually made of steel materials from the standpoints of material cost and mechanical strength. Of these steel materials, alloy tool steels classified as SK, SKS, SKD, SKT, and SKH according to the JIS standards are often used in commercial practice. However, in an attempt to cutoff machine a hard material such as rare earth magnet by a thin OD blade, the prior art core of alloy tool steel is short in mechanical strength and becomes deformed or bowed during cutoff machining, losing dimensional accuracy.

One solution to this problem is a cutoff wheel for use with rare earth magnet alloys comprising a core of cemented carbide to which high hardness abrasive grains such as diamond and cBN are bonded with a binding system such as resin bonding, metal bonding or electroplating, as described in JP-A H10-175172. Use of cemented carbide as the core material mitigates buckling deformation by stresses during machining, ensuring that rare earth magnet is cutoff machined at a high accuracy. However, if a short supply of cutting fluid is provided to the cutting part during machining of rare earth magnet, the cutoff wheel may give rise to problems like glazing or loading even when a core of cemented carbide is used, which problems increase the machining force during the process and induce chipping and bowing, providing a detrimental impact on the machined state.

Approaches to address this problem include arrangement of plural nozzles near the cutoff blades for forcedly feeding cutting fluid to the cutting parts and provision of a high capacity pump to feed a large volume of cutting fluid. The former approach is quite difficult to implement in combination with a multiple blade assembly comprising a plurality of blades arranged at a close spacing of about 1 mm because nozzles cannot be arranged near the blades. In the latter approach of feeding a large volume of cutting fluid, the air streams created around the cutting parts during rotation of the cutoff blades cause the cutting fluid to be divided and scattered away before it reaches the cutting parts. If a high pressure is applied to the cutting fluid to forcedly feed it, the pressure is detrimental to high-accuracy machining because it causes the cutoff blades to be bowed and generates vibration.

CITATION LIST

Patent Document 1: JP-A H10-175172
Patent Document 2: JP-A H07-171765
Patent Document 3: JP-A H05-92420
Non-Patent Document 1: Ninomiya et al., Journal of Japan Society of Precision Engineering, Vol. 73, No. 7, 2007

DISCLOSURE OF INVENTION

An object of the invention is to provide a method for cutoff machining a rare earth magnet block by effectively feeding a relatively small volume of cutting fluid to points of cutoff machining to ensure a high accuracy and a high speed of cutoff machining. Another object is to provide a cutting fluid feed nozzle, a magnet block securing jig, and a magnet block cutoff machining apparatus comprising the same.

In a process of multiple cutoff machining a rare earth magnet block by providing a multiple blade assembly comprising a plurality of cutoff abrasive blades mounted on a rotating shaft at axially spaced apart positions, each blade comprising a core in the form of a thin disk or thin doughnut disk and a peripheral cutting part on an outer peripheral rim of the core, and rotating the plurality of cutoff abrasive blades, the inventors have found that a cutting fluid is effectively fed to the plurality of cutoff abrasive blades by providing a cutting fluid feed nozzle having a cutting fluid inlet at one end and a plurality of slits formed at another end and corresponding to the plurality of cutoff abrasive blades such that an outer peripheral portion of each cutoff abrasive blade may be inserted in the corresponding slit.

While the feed nozzle is combined with the multiple blade assembly such that the outer peripheral portion of each cutoff abrasive blade is inserted into the corresponding slit in the feed nozzle, and the cutting fluid is fed into the feed nozzle through the inlet and injected through the slits, the cutoff abrasive blades are rotated. Then the slits into which the outer peripheral portions of cutoff abrasive blades are inserted serve to restrict any axial run-out of the cutoff abrasive blades during rotation. At the same time, the cutting fluid reaching the slit and coming in contact with the outer peripheral portion of each cutoff abrasive blade is entrained on surfaces of the cutoff abrasive blade being rotated and transported toward the peripheral cutting part of the cutoff abrasive blade by the centrifugal force of rotation. As a result, the cutting fluid is effectively delivered to points of cutoff machining on the magnet block during multiple cutoff machining. By effectively feeding a smaller volume of cutting fluid than in the prior art to points of cutoff machining, cutoff machining of the magnet block can be performed at a high accuracy and a high speed.

In this embodiment, when cutoff grooves corresponding to the plurality of cutoff abrasive blades are formed in the surface of the magnet block, each cutoff groove serves to restrict any axial run-out during rotation of the cutoff abrasive blade whose outer peripheral portion is inserted in the cutoff groove. The cutting fluid flowing from each slit in the feed nozzle and across the surfaces of the cutoff abrasive blade flows into the cutoff groove and is then entrained on the surfaces of the cutoff abrasive blade being rotated whereby the cutting fluid is effectively fed to the blade cutting part during multiple cutoff machining. By effectively feeding a smaller volume of cutting fluid than in the prior art to points of cutoff machining, cutoff machining of the magnet block can be performed at a high accuracy and a high speed.

In connection with a multiple blade assembly for multiple cutoff machining of a rare earth magnet block, the multiple blade assembly comprising a plurality of cutoff abrasive blades mounted on a rotating shaft at axially spaced apart positions, each said blade comprising a core in the form of a thin disk or thin doughnut disk and a peripheral cutting part on an outer peripheral rim of the core, a jig comprising a pair of jig segments for clamping the magnet block in the machining direction for securing the magnet block, wherein one or both of the jig segments are provided on their surfaces with a plurality of guide grooves corresponding to the cutoff abrasive blades so that the outer peripheral portion of each cutoff abrasive blade may be inserted into the corresponding guide groove is effective for fixedly securing the magnet block relative to the multiple blade assembly On use of this jig, the cutoff abrasive blades are rotated while the outer peripheral portions of cutoff abrasive blades are inserted into the corresponding guide grooves. Then the guide grooves serve to restrict any axial run-out of the cutoff abrasive blades during rotation. The cutting fluid flowing from each slit in the feed nozzle and across the surfaces of the cutoff abrasive blade flows in the guide groove and is then entrained on the surfaces of the cutoff abrasive blade being rotated whereby the cutting fluid is effectively fed to the blade cutting part during multiple cutoff machining. By effectively feeding a smaller volume of cutting fluid than in the prior art to points of cutoff machining, cutoff machining of the magnet block can be performed at a high accuracy and a high speed.

In the cutoff machining method, either one or both of the multiple blade assembly (wherein the cutoff abrasive blades are being rotated) and the rare earth magnet block are relatively moved from one end to another end of the magnet block in its longitudinal direction to machine the surface of magnet block to form cutoff grooves of a predetermined depth in the magnet block surface. When the jig is used, and the multiple blade assembly is positioned at opposite ends of the machining stroke, the machining operation is performed in the state that the outer peripheral portion of each cutoff abrasive blade is inserted into the corresponding guide groove.

After the cutoff grooves are formed, the multiple blade assembly is retracted outside the magnet block and either one or both of the multiple blade assembly and the magnet block are relatively moved so as to bring them closer in the depth direction of the cutoff grooves in the magnet block. While the outer peripheral portion of each cutoff abrasive blade is inserted into the cutoff groove in the magnetic block and/or the guide groove in the jig, either one or both of the multiple blade assembly (wherein the cutoff abrasive blades are being rotated) and the magnet block are relatively moved from one end to another end of the magnet block in its longitudinal direction for machining the magnet block. This machining operation is repeated one or more times until the magnet block is cut throughout its thickness.

Accordingly the invention provides a method for multiple cutoff machining a rare earth magnet block, a cutting fluid feed nozzle, a magnet block securing jig, and a magnet block cutoff machining apparatus, as defined below.

[1] A method for multiple cutoff machining a rare earth magnet block, said method comprising the steps of:

providing a multiple blade assembly comprising a plurality of cutoff abrasive blades coaxially mounted on a rotating shaft at axially spaced apart positions, each said blade comprising a core in the form of a thin disk or thin doughnut disk and a peripheral cutting part on an outer peripheral rim of the core, providing a cutting fluid feed nozzle having a cutting fluid inlet at one end and a plurality of slits formed at another end and corresponding to the plurality of cutoff abrasive blades such that an outer peripheral portion of each cutoff abrasive blade may be inserted in the corresponding slit, combining said feed nozzle with said multiple blade assembly such that the outer peripheral portion of each cutoff abrasive blade is inserted into the corresponding slit in said feed nozzle, feeding a cutting fluid into said feed nozzle through the inlet and injecting the cutting fluid through the slits, and rotating the cutoff abrasive blades to cutoff machine the magnet block while the slits in said feed nozzle into which the outer peripheral portions of cutoff abrasive blades are inserted serve to restrict any axial run-out of the cutoff abrasive blades during rotation, wherein the cutting fluid reaching the slits and coming in contact with the outer peripheral portion of each cutoff abrasive blade is entrained on surfaces of the cutoff abrasive blade being rotated and transported toward the peripheral cutting part of the cutoff abrasive blade by the centrifugal force of rotation, whereby the cutting fluid is delivered to points of cutoff machining on the magnet block during multiple cutoff machining.

[2] The method of [1] wherein at an initial stage of cutoff machining of the rare earth magnet block, either one or both of said multiple blade assembly and the magnet block are relatively moved from one end to another end of the magnet block in its longitudinal direction, thereby machining the surface of magnet block to form cutoff grooves of a predetermined depth in the magnet block surface, the cutoff abrasive blades are further rotated to further cutoff machine the magnet block while the cutoff grooves into which the outer peripheral portions of the cutoff abrasive blades are inserted serve to restrict any axial run-out of the cutoff abrasive blades, the cutting fluid flowing in the cutoff groove including the cutting fluid flowing from each slit in said feed nozzle and across the surfaces of the cutoff abrasive blade is entrained on surfaces of the cutoff abrasive blade being rotated whereby the cutting fluid is delivered to points of cutoff machining on the magnet block during multiple cutoff machining.

[3] The method of [2] wherein after the cutoff grooves are formed, said multiple blade assembly is retracted outside the magnet block and either one or both of said multiple blade assembly and the magnet block are relatively moved so as to bring them closer in the depth direction of the cutoff grooves in the magnet block, while the outer peripheral portion of each cutoff abrasive blade is inserted into the cutoff groove in the magnetic block, either one or both of the multiple blade assembly and the magnet block are relatively moved from one end to another end of the magnet block in its longitudinal direction for machining the magnet block, which machining operation is repeated one or more times until the magnet block is cut throughout its thickness.

[4] The method of [3] wherein the depth of the cutoff grooves and the distance of movement in the depth direction after formation of the cutoff grooves are both from 0.1 mm to 20 mm.

[5] The method of [3] or [4] wherein a machining stress along the moving direction during the machining operation is applied to the magnet block being machined in a direction opposite to the moving direction of the multiple blade assembly relative to the magnet block.

[6] The method of any one of [2] to [5] wherein the peripheral cutting part of the cutoff abrasive blade has a width W, and the slit in the feed nozzle has a width of from more than W mm to (W+6) mm.

[7] The method of [1] wherein a jig consisting of a pair of jig segments for clamping the magnet block in the machining direction are provided to secure the magnet block, one or both of the jig segments are provided on their surfaces with a plurality of guide grooves corresponding to the plurality of cutoff abrasive blades such that the outer peripheral portion of each cutoff abrasive blade may be inserted into the corresponding guide groove, the cutoff abrasive blades are rotated while the guide grooves into which the outer peripheral portions of cutoff abrasive blades are inserted serves to restrict any axial run-out of the cutoff abrasive blades during rotation, the cutting fluid flowing in the guide groove including the cutting fluid flowing from each slit in said feed nozzle and across the surfaces of the cutoff abrasive blade is entrained on surfaces of the cutoff abrasive blade being rotated whereby the cutting fluid is delivered to points of cutoff machining on the magnet block during multiple cutoff machining.

[8] The method of [7] wherein the guide grooves in the jig segment extend a length of 1 mm to 100 mm from the magnet block which is secured by the jig.

[9] The method of [7] or [8] wherein at an initial stage of cutoff machining of the rare earth magnet block, either one or both of said multiple blade assembly and the magnet block are relatively moved from one end to another end of the magnet block in its longitudinal direction, thereby machining the surface of magnet block to form cutoff grooves of a predetermined depth in the magnet block surface, with the proviso that during machining at the opposite ends in the machining direction, the outer peripheral portions of cutoff abrasive blades are inserted into the corresponding guide grooves in the jig segments, the cutoff grooves into which the outer peripheral portions of the cutoff abrasive blades are inserted serve to restrict any axial run-out of the cutoff abrasive blades, the cutting fluid flowing in the cutoff groove including the cutting fluid flowing from each slit in said feed nozzle and across the surfaces of the cutoff abrasive blade is entrained on surfaces of the cutoff abrasive blade being rotated whereby the cutting fluid is delivered to points of cutoff machining on the magnet block during multiple cutoff machining.

[10] The method of any one of [7] to [9] wherein after the cutoff grooves are formed, said multiple blade assembly is retracted outside the magnet block and either one or both of said multiple blade assembly and the magnet block are relatively moved so as to bring them closer in the depth direction of the cutoff grooves in the magnet block, while the outer peripheral portion of each cutoff abrasive blade is inserted into the cutoff groove in the magnetic block and/or the guide groove in the jig segment, either one or both of the multiple blade assembly and the magnet block are relatively moved from one end to another end of the rare earth magnet block in its longitudinal direction for machining the magnet block, which machining operation is repeated one or more times until the magnet block is cut throughout its thickness.

[11] The method of [10] wherein the depth of the cutoff grooves and the distance of movement in the depth direction after formation of the cutoff grooves are both from 0.1 mm to 20 mm.

[12] The method of any one of [9] to [11] wherein a machining stress along the moving direction during the machining operation is applied to the magnet block being machined in a direction opposite to the moving direction of the multiple blade assembly relative to the magnet block.

[13] The method of any one of [7] to [12] wherein the peripheral cutting part of the cutoff abrasive blade has a width W, and the slit in the feed nozzle and the guide groove in the jig segment both have a width of from more than W mm to (W+6) mm.

[14] In connection with a multiple blade assembly for multiple cutoff machining of a rare earth magnet block, said multiple blade assembly comprising a plurality of cutoff abrasive blades coaxially mounted on a rotating shaft at axially spaced apart positions, each said blade comprising a core in the form of a thin disk or thin doughnut disk and a peripheral cutting part on an outer peripheral rim of the core, a cutting fluid feed nozzle for feeding a cutting fluid to the multiple blade assembly, said feed nozzle having a cutting fluid inlet at one end and a plurality of slits formed at another end and corresponding to the plurality of cutoff abrasive blades such that an outer peripheral portion of each cutoff abrasive blade may be inserted in the corresponding slit.

[15] The feed nozzle of [14] wherein the peripheral cutting part of the cutoff abrasive blade has a width W, and the slit in the feed nozzle has a width of from more than W mm to (W+6) mm.

[16] An apparatus for cutoff machining a rare earth magnet block, comprising the cutting fluid feed nozzle of [14] or [15].

[17] In connection with a multiple blade assembly for multiple cutoff machining of a rare earth magnet block, said multiple blade assembly comprising a plurality of cutoff abrasive blades coaxially mounted on a rotating shaft at axially spaced apart positions, each said blade comprising a core in the form of a thin disk or thin doughnut disk and a peripheral cutting part on an outer peripheral rim of the core, a jig for fixedly securing the rare earth magnet block comprising a pair of jig segments for clamping the magnet block in the machining direction for securing the magnet block, one or both of the jig segments being provided on their surfaces with a plurality of guide grooves corresponding to the plurality of cutoff abrasive blades so that the outer peripheral portion of each cutoff abrasive blade may be inserted into the corresponding guide groove.

[18] The jig of [17] wherein the guide grooves in the jig segments extend a length of 1 mm to 100 mm from the magnet block which is secured by the jig.

[19] The jig of [17] or [18] wherein the peripheral cutting part of the cutoff abrasive blade has a width W, and the guide groove in the jig segment has a width of from more than W mm to (W+6) mm.

[20] An apparatus for cutoff machining a rare earth magnet block, comprising the jig for securing the magnet block of any one of [17] to [19].

Advantageous Effects of Invention

By effectively feeding a smaller volume of cutting fluid than in the prior art to points of cutoff machining, the magnet block multiple cutoff machining method facilitates cutoff machining of a rare earth magnet block at a high accuracy and a high speed. The invention is of great worth in the industry.

DESCRIPTION OF EMBODIMENTS

Figure 1A:
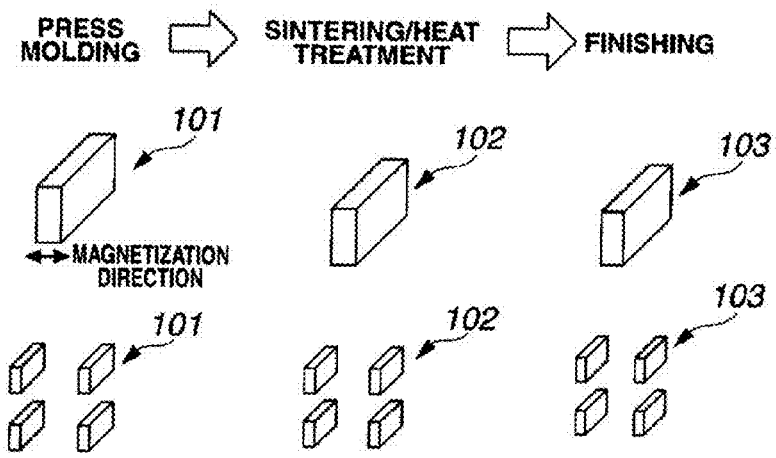
FIG. 1 schematically illustrates rare earth magnet part manufacturing processes including press molding, sintering/heat treating and finishing steps, showing how the shape of parts changes in the successive steps.
Figure 1B:
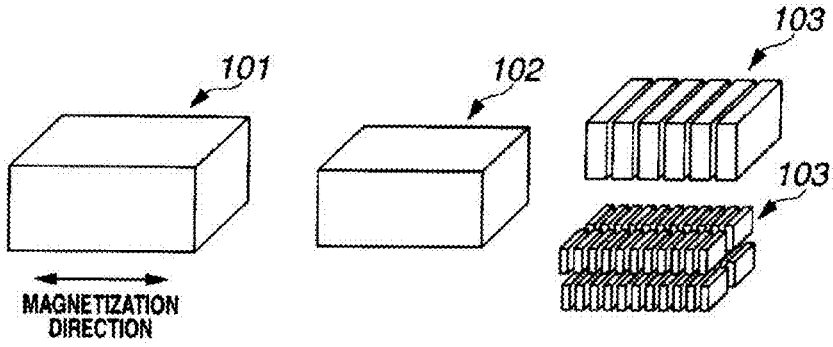

In the following description, like reference characters designate like or corresponding parts throughout the several views shown in the figures. It is also understood that terms such as "upper", "lower", "outward", "inward", and the like are words of convenience, and are not to be construed as limiting terms. The term "axial" is used with respect to the center of a circular blade (or the axis of a shaft) and a direction parallel thereto, and the term "radial" is used with respect to the center of a circular blade.

The method for multiple cutoff machining a rare earth magnet block according to the invention uses a multiple blade assembly comprising a plurality of cutoff abrasive blades coaxially mounted on a rotating shaft at axially spaced apart positions, each blade comprising a core in the form of a thin disk or thin doughnut disk and a peripheral cutting part on an outer peripheral rim of the core. By rotating the cutoff abrasive blades, the magnet block is cutoff machined along multiple lines.

Figure 2:
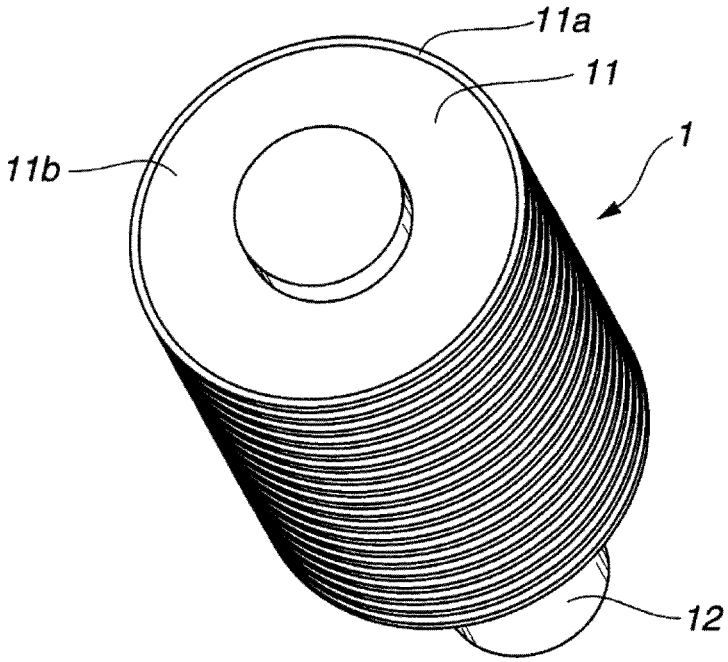
FIG. 2 is a perspective view illustrating one exemplary multiple blade assembly used in the invention.
Figure 3A:
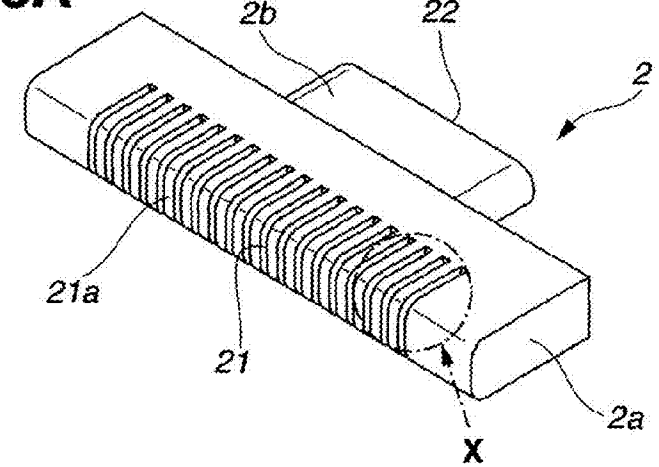
FIG. 3 illustrates one exemplary cutting fluid feed nozzle in one embodiment of the invention, FIG. 3*a* being a perspective view, FIG. 3*b* being a plan view, FIG. 3*c* being a front view, and FIG. 3*d* being an enlarged view of circle X in FIG. 3*a*.
Figure 3D:
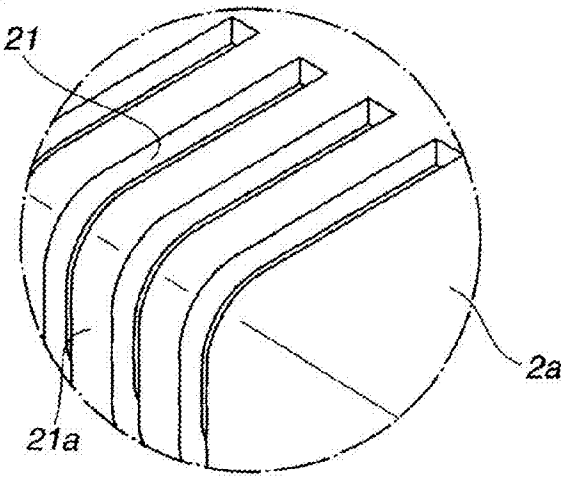
Figure 3B:
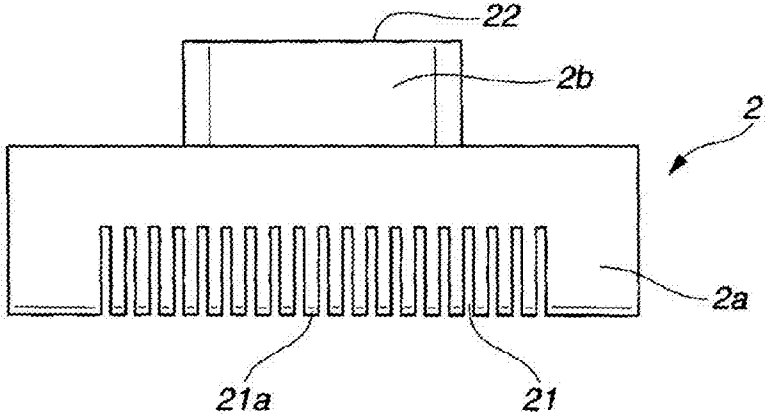
Figure 3C:
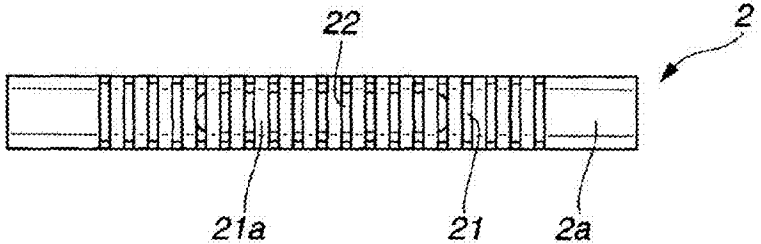
Figure 4C:
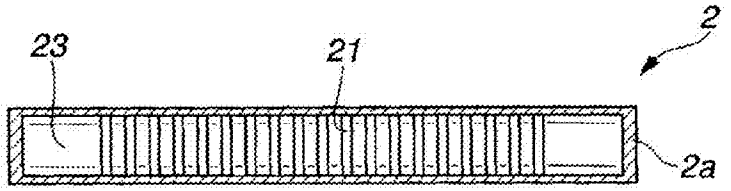
FIG. 4 illustrates another exemplary cutting fluid feed nozzle in one embodiment of the invention, FIG. 4*a* being a plan view, FIGS. 4*b*, 4*c* and 4*d* being cross-sectional views taken along lines B-B, C-C, and D-D in FIG. 4*a*, respectively.
Figure 4A:
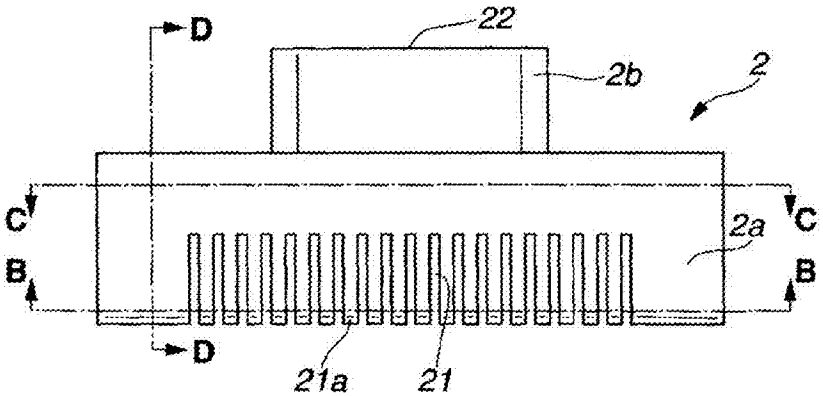
Figure 4B:
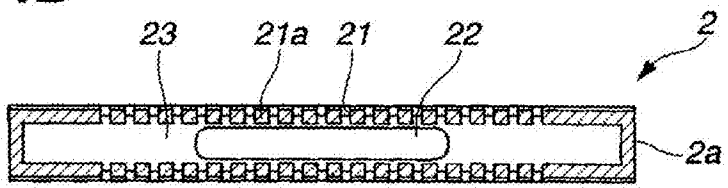
Figure 4D:
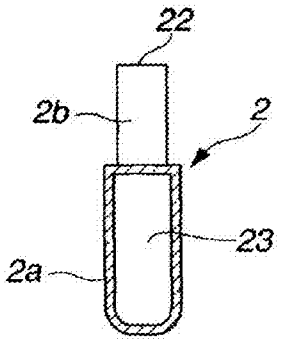
Figure 5A:
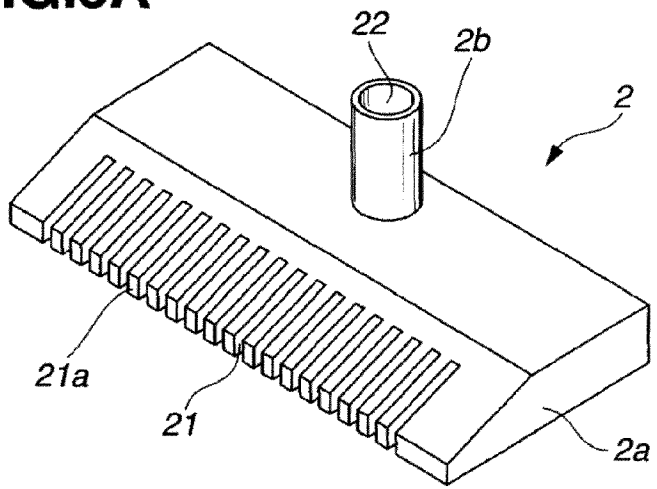
FIG. 5 illustrates a further exemplary cutting fluid feed nozzle in one embodiment of the invention, FIG. 5*a* being a perspective view, FIG. 5*b* being a plan view, FIG. 5*c* being a front view, and FIG. 5*d* being a side view.
Figure 5D:
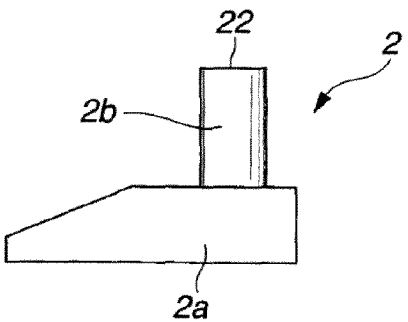
Figure 5B:
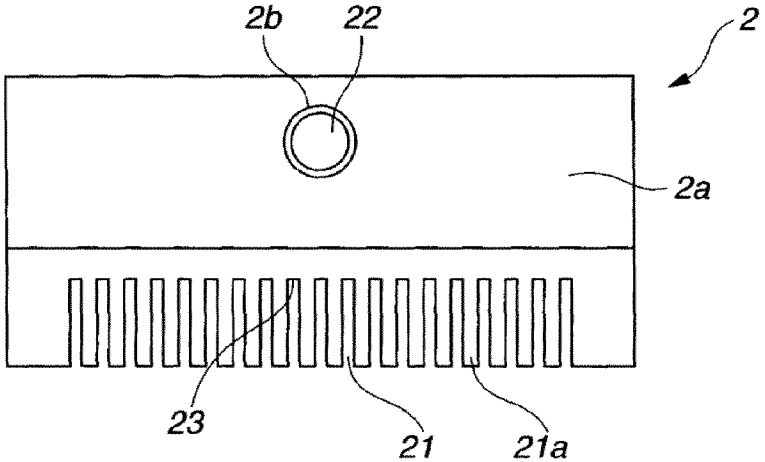
Figure 5C:
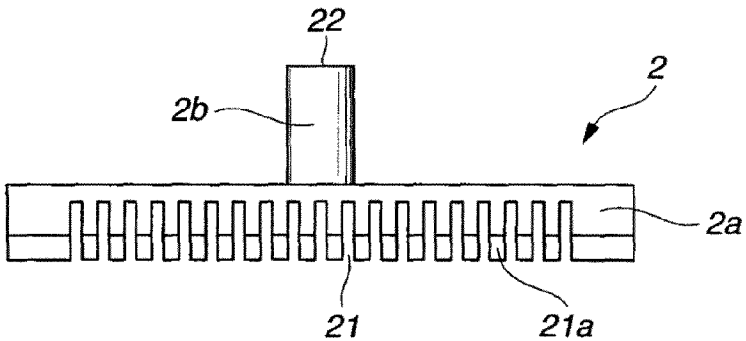

Any prior art well-known multiple blade assembly may be used in the multiple cutoff machining method. As shown in FIG. 2, one exemplary multiple blade assembly 1 includes a rotating shaft 12 and a plurality of cutoff abrasive blades or OD blades 11 coaxially mounted on the shaft 12 alternately with spacers (not shown), i.e., at axially spaced apart positions. Each blade 11 includes a core 11*b* in the form of a thin disk or thin doughnut disk and a peripheral cutting part or abrasive grain-bonded section 11*a* on an outer peripheral rim of the core 11*b*. Note that the number of cutoff abrasive blades 11 is not particularly limited, although the number of blades generally ranges from 2 to 100, with 19 blades illustrated in the example of FIG. 2.

The dimensions of the core are not particularly limited. Preferably the core has an outer diameter of 80 to 200 mm, more preferably 100 to 180 mm, and a thickness of 0.1 to 1.0 mm, more preferably 0.2 to 0.8 mm. The core in the form of a thin doughnut disk has a bore having a diameter of preferably 30 to 80 mm, more preferably 40 to 70 mm.

The core of the cutoff abrasive blade may be made of any desired materials commonly used in cutoff blades including steels SK, SKS, SKD, SKT and SKH, although cores of cemented carbide are preferred because the cutting part or blade tip can be thinner. Suitable cemented carbides of which cores are made include alloy forms of powdered carbides of metals in Groups IVB, VB and VIB in the Periodic Table, such as WC, TiC, MoC, NbC, TaC, and $Cr_3C_2$, which are cemented with Fe, Co, Ni, Mo, Cu, Pb, Sn or alloys thereof. Of these, WC—Co, WC—Ni, TiC—Co, and WC—TiC—TaC—Co systems are typical and preferred for use herein.

The peripheral cutting part or abrasive grain-bonded section is formed to cover the outer peripheral rim of the core and consists essentially of abrasive grains and a binder. Typically diamond grains, cBN grains or mixed grains of diamond and cBN are bonded to the outer peripheral rim of the core using a binder. Three binding systems including resin bonding with resin binders, metal bonding with metal binders, and electroplating are typical and any of them may be used herein.

The peripheral cutting part or abrasive grain-bonded section has a width W in the thickness or axial direction of the core, which is from (T+0.01) mm to (T+4) mm, more preferably (T+0.02) mm to (T+2) mm, provided that the core has a thickness T. An outer portion of the peripheral cutting part or abrasive grain-bonded section that projects radially outward from the outer peripheral rim of the core has a projection distance which is preferably 0.1 to 10 mm, more preferably 0.3 to 8 mm, depending on the size of abrasive grains to be bonded. An inner portion of the peripheral cutting part or abrasive grain-bonded section that radially extends on the core has a coverage distance which is preferably 0.1 to 10 mm, more preferably 0.3 to 8 mm.

The spacing between cutoff abrasive blades may be suitably selected depending on the thickness of magnet pieces after cutting, and preferably set to a distance which is slightly greater than the thickness of magnet pieces, for example, by 0.01 to 0.4 mm.

For machining operation, the cutoff abrasive blades are preferably rotated at 1,000 to 15,000 rpm, more preferably 3,000 to 10,000 rpm.

Fluid Feed Nozzle

During multiple cutoff machining of a rare earth magnet block, a cutting fluid must be fed to the cutoff abrasive blades to facilitate machining. To this end, the invention uses a cutting fluid feed nozzle having a cutting fluid inlet at one end and a plurality of slits formed at another end and corresponding to the plurality of cutoff abrasive blades such that an outer peripheral portion of each cutoff abrasive blade may be inserted in the corresponding slit.

As shown in FIGS. 3 and 4, the cutting fluid feed nozzle 2 includes a hollow nozzle housing 2*a* and a lateral conduit 2*b*. The conduit 2*b* has one end which is open to define an inlet 22 for cutting fluid and another end attached to one side of the hollow nozzle housing 2*a* to provide fluid communication with the hollow interior or fluid distributing reservoir 23 of the housing 2*a*. A portion of the hollow nozzle housing 2*a* which is opposed to the one side (or conduit 2*b*) is provided with a plurality of slits 21. The number of slits corresponds to the number of cutoff abrasive blades and is typically equal to the number of cutoff abrasive blades in the multiple blade assembly. The number of slits is not particularly limited although the number of slits generally ranges from 2 to 100, with 19 slits illustrated in the examples of FIGS. 3 and 4. For the purpose of controlling the amount of cutting fluid injected through the slits, the number of slits may be greater than the number of blades so that during operation of the nozzle when the blades are inserted in slits, some outside slits are left open.

The feed nozzle 2 is combined with the multiple blade assembly 1 such that an outer peripheral portion of each cutoff abrasive blade 11 may be inserted into the corresponding slit 21 in the feed nozzle. Then the slits 21 are arranged at a spacing which corresponds to the spacing between cutoff abrasive blades 11, and the slits 21 extend straight and parallel to each other.

The shape and position of the feed nozzle, slits and inlet are not limited to those shown in FIGS. 3 and 4. Another exemplary cutting fluid feed nozzle is illustrated in FIG. 5. This cutting fluid feed nozzle 2 includes a hollow nozzle housing 2*a* and a standing conduit 2*b*. The conduit 2*b* has an upper end which is open to define an inlet 22 for cutting fluid and a lower end attached to an upper wall of the hollow nozzle housing 2*a* to provide fluid communication with the hollow interior or fluid distributing reservoir 23 of the housing 2*a*. A front portion of the hollow nozzle housing 2*a* which is remote from the conduit 2*b* is provided with a plurality of slits 21. The number of slits corresponds to the number of cutoff abrasive blades and is typically equal to the number of cutoff abrasive blades in the multiple blade assembly. The number of slits is not particularly limited although the number of slits generally ranges from 2 to 100, with 19 slits illustrated in the example of FIG. 5. The front portion of the nozzle housing 2*a* which is provided with slits has an upper wall tapered toward the distal ends of slits so that the nozzle housing 2*a* (or hollow interior) has a reduced size (or thickness) at the slit distal ends. Also in this embodiment, the slits 21 are arranged at a spacing which corresponds to the spacing between cutoff abrasive blades 11, and the slits 21 extend straight and parallel to each other. In this feed nozzle wherein the slit portion of the housing is tapered, the cutting fluid may be more positively injected toward the cutoff abrasive blades. Likewise, for the purpose of controlling the amount of cutting fluid injected through the slits, the number of slits may be greater than the number of blades so that during operation of the nozzle when the blades are inserted in slits, some outside slits are left open.

The outer peripheral portion of each cutoff abrasive blade which is inserted into the corresponding slit in the feed nozzle functions such that the cutting fluid coming in contact with the cutoff abrasive blades is entrained on the surfaces (outer peripheral portions) of the cutoff abrasive blades and transported to points of cutoff machining on the magnet block. Then the slit has a width which must be greater than the width of the cutoff abrasive blade (i.e., the width W of the outer cutting part). Through slits having too large a width, the cutting fluid may not be effectively fed to the cutoff abrasive blades and a more fraction of cutting fluid may drain away from the slits. Provided that the peripheral cutting part of the cutoff abrasive blade has a width W (mm), the slit in the feed nozzle preferably has a width of from more than W mm to (W+6) mm, more preferably from (W+0.1) mm to (W+6) mm.

The slit portion 21*a* of the feed nozzle 2 is defined by a wall having a certain thickness. A thin wall has a low strength so that the slits may be readily deformed by contact with the blades or the like, failing in a stable supply of cutting fluid. If the wall is too thick, the nozzle interior may become too narrow to define a flowpath and the outer peripheral portion of the cutoff abrasive blade which is inserted into the slit may not come in full contact with the cutting fluid within the feed nozzle. Then the slit portion 21*a* of the feed nozzle 2 has a wall thickness which varies depending on the material of which it is made, and preferably is 0.5 to 10 mm when the wall is made of plastics, and 0.1 to 5 mm when the wall is made of metal materials.

The slit has such a length that when the outer peripheral portion of the cutoff abrasive blade is inserted into the slit, the outer peripheral portion may come in full contact with the cutting fluid within the feed nozzle. Often, the slit length is preferably about 2% to 30% of the outer diameter of the core of the cutoff abrasive blade. It is also preferred that when the outer peripheral portion of the cutoff abrasive blade is inserted into the slit, the slit be substantially blocked with the blade, but without contact with the blade. For the purpose of injecting some of the cutting fluid directly to the cutoff abrasive blade, the magnet block being machined, and a magnet block securing jig to be described later, the slit may have such a length that when the outer peripheral portion of the cutoff abrasive blade is inserted into the slit, a proximal portion of the slit is left unblocked.

Figure 6:
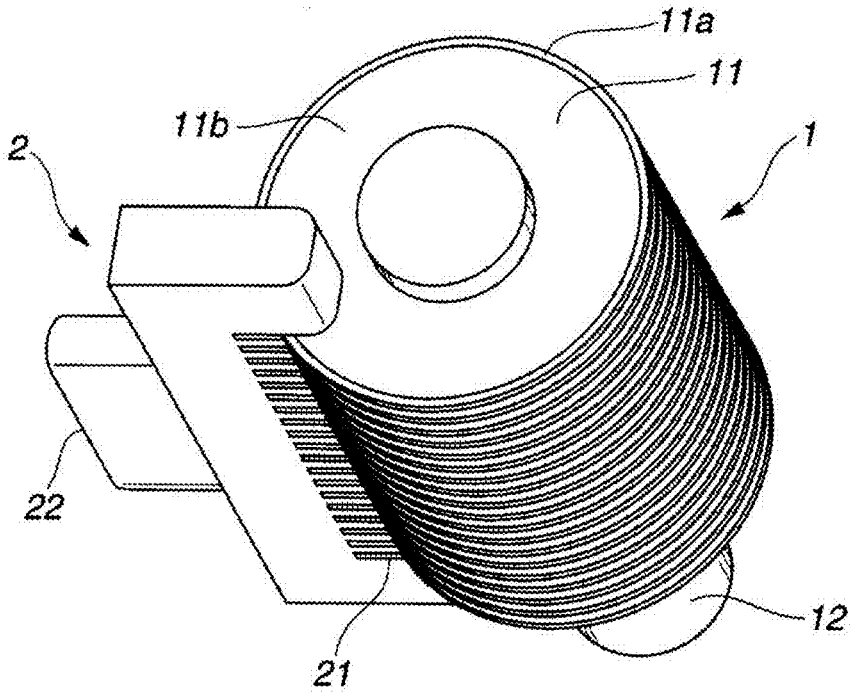
FIG. 6 is a perspective view showing a combination of the multiple blade assembly of FIG. 2 with the cutting fluid feed nozzle of FIG. 3, with cutoff abrasive blades being inserted into slits in the feed nozzle.
Figure 7:
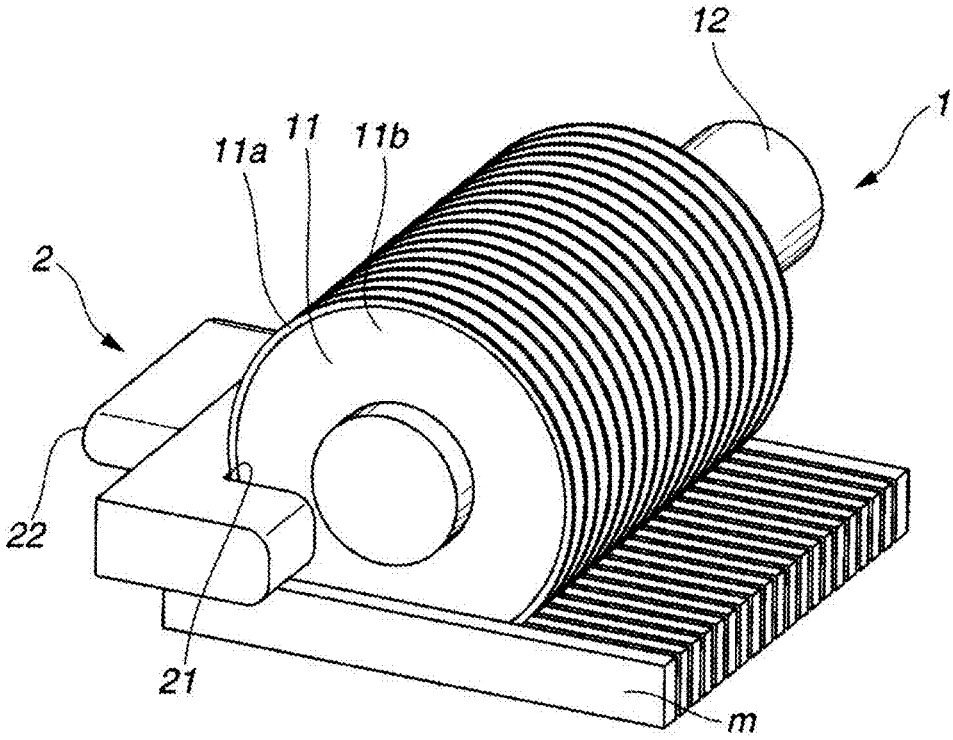
FIG. 7 is a perspective view illustrating that the rare earth magnet block is cutoff machined using the combination of multiple blade assembly with cutting fluid feed nozzle in FIG. 6.

The feed nozzle 2 is combined with the multiple blade assembly 1 as shown in FIGS. 6 and 7 such that the outer peripheral portion of the cutoff abrasive blade 11 is inserted into the slit 21 in the feed nozzle 2. In this state, cutting fluid is introduced into the feed nozzle 2 through the inlet 22 and injected through the slits 21, and the cutoff abrasive blades 11 are rotated. Then the magnet block M is cut off by the peripheral cutting parts 11*a* of the blades 11. The feed nozzle may be opposed to the magnet block with the cutoff abrasive blades interposed therebetween. Alternatively, the feed nozzle may be disposed above the magnet block such that the cutoff abrasive blades may pass through the slits in the feed nozzle vertically downward or upward. It is noted that the construction of the multiple blade assembly 1 in FIGS. 6 and 7 is the same as in FIG. 2, with like reference characters designating like parts.

A relatively close distance between the slits in the feed nozzle and the magnet block is advantageous in a supply of cutting fluid by entrainment on the cutoff abrasive blade surfaces, but too close a distance may interfere with motion of the cutoff abrasive blades and magnet block, injection and drainage of cutting fluid, or the like. The distance between the slits in the feed nozzle and the magnet block is preferably selected such that the distance between the feed nozzle and the upper surface of the magnet block is in the range of 1 to 50 mm at the end of machining (in the illustrated example, the feed nozzle is spaced 1 to 50 mm apart from the upper surface of the magnet block at the end of machining).

In the setting that the multiple blade assembly, feed nozzle and magnet block are disposed as described above, while the cutoff abrasive blades are rotated, either one or is both of the multiple blade assembly combined with the feed nozzle and the magnet block are relatively moved (in the longitudinal and/or thickness direction of magnet block) with the cutting parts kept in contact with the magnet block, whereby the magnet block is machined. When the magnet block is machined in this way, a high accuracy of cutoff machining is possible since the slits serve to restrict any axial runout of the cutoff abrasive blades being rotated.

Around the cutoff abrasive blades which rotate at a high velocity, air streams are produced. The air streams form so as to surround the peripheral cutting parts of the cutoff abrasive blades. Thus if cutting fluid is directly injected toward the peripheral cutting parts of the cutoff abrasive blades, the cutting fluid contacts with the air streams and is scattered away thereby. That is, the air layer obstructs the contact of cutting fluid with the cutting parts and hence an efficient supply of cutting fluid. In contrast, in the setting that the outer peripheral portions of the cutoff abrasive blades are inserted into the slits in the feed nozzle so that the cutoff abrasive blades contact with the cutting fluid in the interior of the feed nozzle, the air streams are blocked by the feed nozzle housing (slit portion) so that the cutting fluid may contact with the outer peripheral portions of the cutoff abrasive blades without obstruction by the air layer.

Accordingly, the cutting fluid that has reached the slits in the feed nozzle and contacted with the outer peripheral portions of the cutoff abrasive blades is entrained by the surfaces (outer peripheral surface and radially outer portions of side surfaces) of the cutoff abrasive blades being rotated and, under the centrifugal force due to rotation of the cutoff abrasive blades, transported toward the peripheral cutting parts of the cutoff abrasive blades. The cutting fluid that has reached the peripheral cutting parts is transported to points of cutoff machining on the magnet block as the cutoff abrasive blades rotate. This ensures that the cutting fluid is efficiently delivered to the points of cutoff machining. This, in turn, permits to reduce the amount of cutting fluid fed. Additionally, the areas of machining can be effectively cooled.

It is evident that the cutting fluid feed nozzle of the invention is effective in feeding cutting fluid to an apparatus for cutoff machining a rare earth magnet block.

Jig

In the method for multiple cutoff machining a rare earth magnet block, the magnet block is machined by cutoff abrasive blades while feeding cutting fluid to the cutoff abrasive blades. In the process, a magnet block securing jig consisting of a pair of jig segments is preferably used for clamping the magnet block in the machining direction for fixedly securing the magnet block. One or both of the jig segments are provided on their surfaces with a plurality of guide grooves corresponding to the cutoff abrasive blades so that the outer peripheral portion of each cutoff abrasive blade may be inserted into the corresponding guide groove.

FIG. 8 shows one exemplary magnet block securing jig consisting of a pair of jig segments. Disposed on a table 30 is a support plate 32 on which a magnet block M is rested. A pair of jig segments 31, 31 are disposed at longitudinally opposed ends of the support plate 32 (FIG. 8*a*). The pair of jig segments 31, 31 are adapted to clamp the magnet block M in the machining direction (longitudinal direction) for fixedly securing the magnet block M to the table 30 (FIG. 8*b*). The jig often consists of a pair of jig segments although the number of jig segments is not limited. Once the jig segments 31, 31 are placed to clamp the magnet block M from its opposite ends, the jig segments 31 are detachably secured to the table 30 by threading screws 31*b*, keeping the block clamped. Although the screws 31*b* are used to secure the jig segments 31 to the table 30 in the embodiment of FIG. 8, the securing means is not limited thereto, and the jig segments may be secured, for example, by utilizing a pneumatic or hydraulic pressure.

The jig segments 31, 31 are provided on their surfaces with a plurality of guide grooves 31*a* corresponding to cutoff abrasive blades 11 of multiple blade assembly 1. Note that the number of guide grooves 31*a* is not particularly limited, although 19 grooves are illustrated in the example of FIG. 8.

The outer peripheral portion of each cutoff abrasive blade may be inserted into the corresponding guide groove 31*a* in the jig 31 as will be described later. Then the guide grooves 31*a* are arranged at a spacing which corresponds to the spacing between cutoff abrasive blades 11, and the guide grooves 31*a* extend straight and parallel to each other. The distance between adjacent guide grooves 31*a* is equal to or less than the thickness of magnet pieces divided (cut) from the magnet block.

When the magnet block is secured by the jig and the cutting fluid is fed from the feed nozzle, the cutting fluid that has contacted with the outer peripheral portion of each cutoff abrasive blade within the feed nozzle is entrained by the surfaces of the cutoff abrasive blade, introduced into the corresponding guide groove in the jig, transported to the magnet block and thus delivered to the point of cutoff machining. In the case of machining with the feed nozzle used or even without using the feed nozzle (for example, in case cutting fluid is directly injected to the cutoff abrasive blades), if a provision is made such that the cutting fluid may flow into the guide grooves, then the cutting fluid contacts with the outer peripheral portions of the cutoff abrasive blades when they run through the guide grooves, is entrained on the surfaces (outer peripheral portions) of the cutoff abrasive blades, transported toward the magnet block, and delivered to the points of cutoff machining. Then the width of each guide groove should be greater than the width of each cutoff abrasive blade (i.e., the width of the peripheral cutting part). If the width of each guide groove is too large, the cutting fluid cannot be effectively fed to the cutoff abrasive blade. Provided that the peripheral cutting part of the cutoff abrasive blade has a width W (mm), the guide groove should preferably have a width of more than W mm to (W+6) mm and more preferably from (W+0.1) mm to (W+6) mm.

The guide groove has a length in the machining direction which is preferably in the range of 1 mm to 100 mm, and more preferably 3 mm to 100 mm, as measured from the magnet block which is fixedly secured by the jig. If the guide groove has a length of less than 1 mm, the guide groove is less effective in preventing scattering of the cutting fluid or accommodating the cutting fluid when the cutting fluid is delivered to the workpiece or magnet block, and less effective in providing a sufficient strength to keep the magnet block fixed. If the guide groove has a length of more than 100 mm, the effect of delivering the cutting fluid to the machining area and the effect of providing a sufficient strength to keep the magnet block fixed are no longer enhanced, and the overall machining apparatus becomes large sized without merits. The depth of each guide groove is selected appropriate depending on the height of the magnet block. Preferably, the guide grooves are formed in the jig segment slightly deeper than the lower surface of the magnet block secured by the jig.

As shown in FIG. 8, the support plate 32 is provided on its upper surface with a plurality of grooves corresponding to the guide grooves in the jig segments (having a width equal to the width of the guide grooves in FIG. 8, but not limited thereto). Since the outer peripheral portions of the cutoff abrasive blades project below the lower surface of the magnet block at the final stage of cutoff machining of the magnet block, these grooves offer spaces to accommodate the projecting outer peripheral portions of the cutoff abrasive blades. The pre-grooved support plate is preferred because any extra load for the cutoff abrasive blades to machine the support plate is eliminated.

The jig segments may be made of any materials having a strength to withstand clamping forces, preferably high-strength engineering plastics, iron, stainless steel or aluminum base materials, as well as cemented carbides and high-strength ceramics if a space saving is desirable.

The guide grooves in the jig segments and grooves in the support plate may be preformed. Alternatively, they may be formed in the first cycle of cutoff machining by cutoff machining a magnet block or dummy workpiece which is properly secured until grooves are formed in the jig segments and support plate, which process is known as co-machining.

Figure 8A:
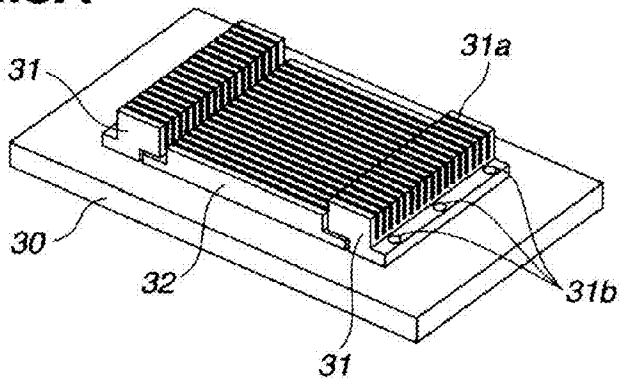
FIG. 8 illustrates in perspective view the steps of cutoff machining a rare earth magnet block using one exemplary magnet block securing jig in another embodiment of the invention.
Figure 8B:
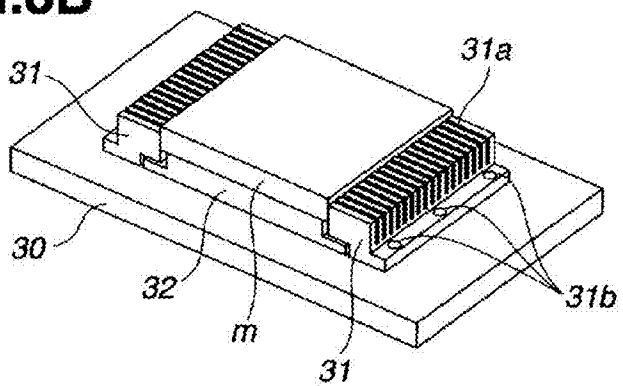
Figure 8C:
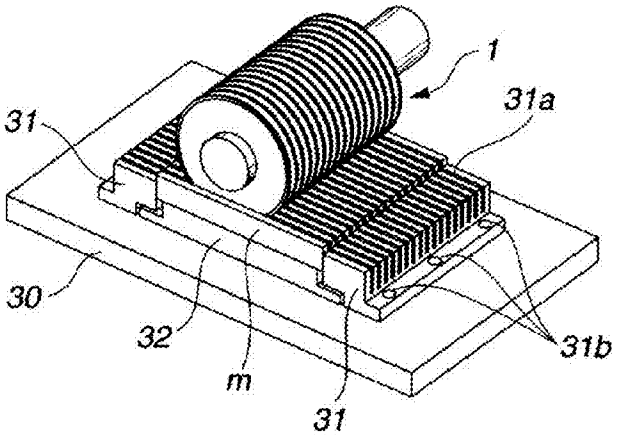
Figure 8D:
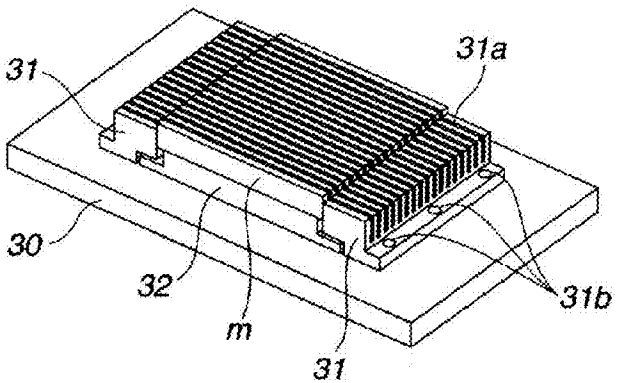
Figure 9A:
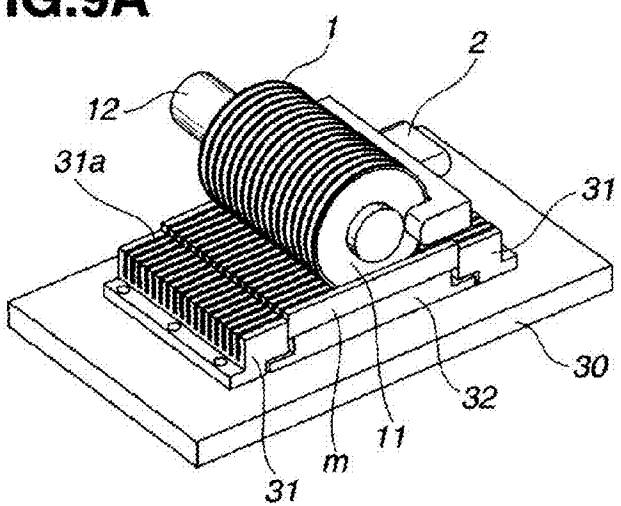
FIG. 9 illustrates in perspective view the process of cutoff machining a rare earth magnet block using one exemplary multiple blade assembly, one exemplary cutting fluid feed nozzle, and one exemplary magnet block securing jig, FIG. 9*a* being a perspective view, FIG. 9*b* being a plan view, FIG. 9*c* being a side view, and FIG. 9*d* being a front view.
Figure 9B:
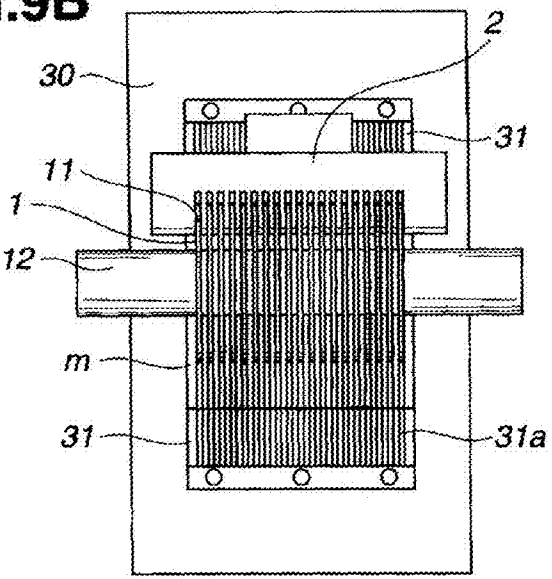
Figure 9D:
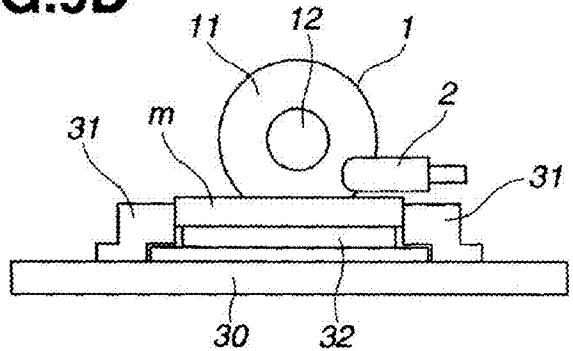
Figure 9C:
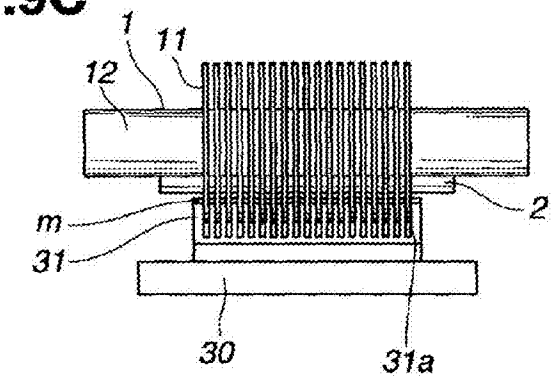

In the embodiment using the magnet block securing jig and preferably the support plate as shown in FIG. 8*a*, the jig segments clamping the magnet block is retained as shown in FIG. 8*b*, whereby the magnet block is fixedly secured. The outer peripheral portion of each cutoff abrasive blade of the multiple blade assembly is inserted into the corresponding guide groove in the jig. In this state, the cutting fluid from the feed nozzle is fed to the cutoff abrasive blades or flowed into the guide grooves in the jig while the cutoff abrasive blades are rotated. With the peripheral cutting part (abrasive grain-bonded section) in contact with the magnet block, the multiple blade assembly and the magnet block are relatively moved (in the longitudinal and/or thickness direction of the magnet block). The magnet block M is machined by the peripheral cutting parts of the cutoff abrasive blades as shown in FIG. 8*c*. Then the magnet block M is cut into elongated pieces as shown in FIG. 8*d*.

On use of the cutting fluid feed nozzle in combination with the jig, the feed nozzle is preferably set such that the slits in the feed nozzle are in fluid communication with the guide grooves in the jig. For a supply of cutting fluid by entrainment on the surfaces of the cutoff abrasive blades, it is advantageous that the slits in the feed nozzle are positioned not so remote from the guide grooves in the jig. Inversely, too close an arrangement between the slits in the feed nozzle and the guide grooves in the jig may interfere with movement of the multiple blade assembly and magnet block, injection and drainage of cutting fluid, or the like. Then the distance between the slits in the feed nozzle and the guide grooves in the jig is preferably such that the distance between the feed nozzle and the upper surface of the jig is 1 to 50 mm at the end of machining operation (for example, the feed nozzle is positioned 1 to 50 mm higher than the upper surface of the jig in the illustrated embodiment).

In multiple cutoff machining of a magnet block, the magnet block is fixedly secured by any suitable means. In the prior art, the magnet block is bonded to a support plate (e.g., of carbon base material) with wax or a similar adhesive which can be removed after machining operation, whereby the magnet block is fixedly secured prior to machining operation. This technique, however, requires extra steps of bonding, stripping and cleaning and is thus cumbersome. In contrast, the jig is used herein for clamping the magnet block for fixedly securing it. This achieves a saving of processing labor because the steps of bonding, stripping and cleaning are omitted.

When the magnet block is cut by the multiple blade assembly in the described arrangement of the multiple blade assembly, jig and magnet block, the guide grooves in the jig serve to restrict any axial runout of the cutoff abrasive blades during machining operation, ensuring cutoff machining at a high precision and accuracy.

Around the cutoff abrasive blades which rotate at a high velocity, air streams are produced. The air streams form so as to surround the peripheral cutting parts of the cutoff abrasive blades. Thus if cutting fluid is directly injected toward the peripheral cutting parts of the cutoff abrasive blades, the cutting fluid contacts with the air streams and is scattered away thereby. That is, the air layer obstructs the contact of cutting fluid with the cutting parts and hence an efficient supply of cutting fluid. In contrast, in the setting that the outer peripheral portions of the cutoff abrasive blades are inserted into the guide grooves in the jig segments, the air streams are blocked by the jig segment (groove-defining portion) so that the cutting fluid flowing in the guide grooves may contact with the outer peripheral portions of the cutoff abrasive blades without obstruction by the air layer. When both the feed nozzle and the jig are used, their synergistic effect ensures that the cutting fluid is effectively delivered to the points of cutoff machining.

Accordingly, the cutting fluid that has contacted with the outer peripheral portions of the cutoff abrasive blades is entrained by the surfaces (outer peripheral surface and radially outer portions of side surfaces) of the cutoff abrasive blades being rotated, and transported toward the peripheral cutting parts of the cutoff abrasive blades under the centrifugal force due to rotation of the cutoff abrasive blades. The cutting fluid that has reached the peripheral cutting parts is transported to points of cutoff machining on the magnet block along with the rotation of the cutoff abrasive blades. This ensures that the cutting fluid is efficiently delivered to the points of cutoff machining. This, in turn, permits to reduce the amount of cutting fluid fed. Additionally, the areas of machining can be effectively cooled.

It is evident that the magnet block securing jig of the invention is effective in fixedly securing the magnet block to a rare earth magnet block cutoff machining apparatus.

FIG. 9 illustrates a full setup. When a magnet block is cutoff machined by the multiple blade assembly which is combined with the cutting fluid feed nozzle and the magnet block securing jig as shown in FIG. 9, all the above-described advantages are obtainable. Specifically, the arrangement of the cutting fluid feed nozzle and the magnet block jig exerts both the effect of guiding the cutoff abrasive blades and the effect of feeding the cutting fluid by entrainment on the surfaces of the cutoff abrasive blades, continuously in the rotational direction of the cutoff abrasive blades. It is noted that the construction of the multiple blade assembly 1, the cutting fluid feed nozzle 2 and the magnet block securing jig 31 in FIG. 9 is the same as in FIGS. 7 and 8, with like reference characters designating like parts. Although a single magnet block is machined by the multiple blade assembly in the embodiment shown in FIG. 9, the number of magnet blocks to be machined is not particularly limited. Two or more magnet blocks which are arranged in parallel and/or series may be machined by a single multiple blade assembly.

The workpiece or magnet block to be machined herein has a surface which is generally flat. At the initial stage of machining, the cutting fluid is fed to the flat surface. If cutting fluid is injected onto the flat surface, the fluid will readily flow away, failing in an effective delivery of the fluid to points of cutoff machining. Preferably at the initial stage of machining of a magnet block (or on the first stroke of machining), either one or both of the multiple blade assembly and the magnet block are relatively moved in the machining (or longitudinal) direction of the magnet block from one end to another end of the magnet block in its longitudinal direction, whereby the surface of the magnet block is machined to a certain depth throughout the longitudinal direction to form cutoff grooves in the magnet block. Particularly when the magnet block securing jig is used, machining operation is continued to the opposite ends in the machining direction, in the state that the outer peripheral portions of the cutoff abrasive blades are inserted into the guide grooves in the jig.

Once the cutoff grooves are formed in the first stroke of machining in this way, these grooves serve as guides for the cutoff abrasive blades in the subsequent stroke of machining for restrict any axial runout of the cutoff abrasive blades during rotation, achieving cutoff machining operation at a high accuracy.

If cutoff grooves are initially formed, the cutting fluid that has reached the surface of the workpiece or magnet block flows in the cutoff grooves and in the case where the feed nozzle is used, the cutting fluid flows in the cutoff grooves along with the cutting fluid which has been transported by entrainment on the surfaces of the cutoff abrasive blades from the slits in the feed nozzle. The cutting fluid is further entrained on the surfaces of the cutoff abrasive blades being rotated. With rotation of the cutoff abrasive blades, the cutting fluid is transported to points of cutoff machining on the magnet block. This ensures that the cutting fluid is efficiently delivered to the points of cutoff machining. This, in turn, permits to reduce the amount of cutting fluid fed. Additionally, the areas of machining can be effectively cooled.

As compared with a situation that cutoff abrasive blades continue machining of an overall flat surface of a magnet block to a deeper level, the mode of initially forming cutoff grooves has the advantage that the cutoff grooves function, during the subsequent stroke of machining, as channels for effectively delivering the cutting fluid to points of cutoff machining. With rotation of the cutoff abrasive blades, the cutting fluid is effectively drained from the points of cutoff machining, through the cutoff grooves, and downstream in the rotating direction of the cutoff abrasive blades. Together with the cutting fluid, machining sludge is effectively drained through the cutoff grooves. This offers a good machining environment which causes little or no glazing or loading of the abrasive grain section.

The cutoff grooves initially formed preferably have a depth of 0.1 mm to 20 mm, more preferably 1 mm to 10 mm (depth of first machining by movement in the longitudinal direction of the magnet block). If the cutoff grooves have a depth of less than 0.1 mm, they are less effective in preventing the cutting fluid from being scattered away on the magnet block surface, failing to deliver the cutting fluid to points of cutoff machining. If the cutoff grooves have a depth of more than 20 mm, machining operation of such deep cutoff grooves may be performed under a short supply of cutting fluid, failing in groove cutting at a high accuracy.

The cutoff grooves have a width which is determined by the width of the cutoff abrasive blades. Usually, the width of the cutoff grooves is slightly greater than the width of the cutoff abrasive blades due to the vibration of the cutoff abrasive blades during machining operation, and specifically in the range from more than the width of the cutoff abrasive blades (or peripheral cutting part) to 2 mm, and more preferably up to 1 mm.

Once the cutoff grooves are formed, the magnet block is further machined by the multiple blade assembly until it is completely cut into discrete pieces. For example, after the cutoff grooves are formed, the multiple blade assembly is retracted outside the magnet block and either one or both of the multiple blade assembly and the magnet block are relatively moved so as to bring them closer in the depth direction of the cutoff grooves in the magnet block (the distance between the lower tip of each cutoff abrasive blade and the upper surface of the magnet block becomes more negative). While the outer peripheral portion of each cutoff abrasive blade is inserted into the cutoff groove in the magnetic block, and in case the jig is used, the outer peripheral portion of each cutoff abrasive blade is inserted into the guide groove in the jig or into both the guide groove and the cutoff groove, either one or both of the multiple blade assembly and the magnet block are relatively moved in the machining direction (longitudinal direction of the magnet block) from one end to another end of the magnet block in its longitudinal direction for machining the magnet block. This machining operation is repeated one or more times until the magnet block is cut off throughout its thickness. The movement distance in the depth direction of cutoff grooves (or cutoff depth after downward movement) is preferably in the range of 0.1 mm to 20 mm, and more preferably 1 mm to 10 mm.

The rotational velocity of the cutoff abrasive blades during the formation of initial cutoff grooves may be different from the rotational velocity of the cutoff abrasive blades during the subsequent machining of the magnet block. The moving speed of the blade assembly during the formation of initial cutoff grooves may also be different from the moving speed of the blade assembly during the subsequent machining of the magnet block.

During machining operation (machining to form initial cutoff grooves and/or subsequent machining) by the multiple blade assembly moving in the longitudinal direction of the magnet block or cutoff grooves therein, a machining stress along the moving direction is applied to the magnet block being machined, preferably in a direction opposite to the moving direction of the multiple blade assembly relative to the magnet block.

Machining operation is preferably performed such that a force in a direction opposite to the moving direction of the multiple blade assembly relative to the workpiece or magnet block (relative movement means that either the magnet block or the multiple blade assembly may be moved) may be applied from the multiple blade assembly (specifically cutoff abrasive blades) to the magnet block. The reason is that if a force is applied in the forward moving direction of the multiple blade assembly relative to the magnet block, the cutoff abrasive blades receive a reaction from the magnet block, and thus the cutoff abrasive blades receive a compression stress. If a compression stress is applied to the cutoff abrasive blades, the blades are bowed, leading to a loss of machining accuracy and side abrasion by contact of the core of the cutoff abrasive blade with the magnet block being machined. This not only invites a loss of machining accuracy, but also causes temperature elevation by frictional contact, detrimental effect on the magnet block, and failure of the cutoff abrasive blades.

If the force applied from the cutoff abrasive blades to the magnet block is in a direction opposite to the forward moving direction of the multiple blade assembly, no compression stress is applied to the cutoff abrasive blades, preventing side abrasion and increasing the machining accuracy. Since no compression force is applied between the cutoff abrasive blades and the magnet block, machining sludge is effectively drained together with the cutting fluid, and the cutoff abrasive blades are kept sharp.

In order to produce a force inverse to the forward moving direction of the multiple blade assembly, the peripheral speed of the cutoff abrasive blades, the cross-sectional area of machining (machining height multiplied by width of cutoff abrasive blade), and the forward moving speed of the multiple blade assembly are pertinent. If the peripheral speed is higher, a force inverse to the forward moving direction of the blade is produced due to the frictional resistance between the rotating blade and the magnet block. However, a stress is produced in the forward moving direction due to the forward movement of the multiple blade assembly. This stress multiplied by the cross-sectional area of machining gives a force in the forward moving direction. Of this force, the stress acting inverse to the moving direction due to the rotational force of the cutoff abrasive blades must be greater than the stress by the movement of the cutoff abrasive blades.

To meet the above requirement, for example, the peripheral speed of the cutoff abrasive blades is preferably at least 20 m/sec. To reduce the cross-sectional area of machining, the width of the cutoff abrasive blades (i.e., the width of peripheral cutting part) is preferably up to 1.5 mm. If the blade width is less than 0.1 mm, the cross-sectional area of machining may be reduced at the sacrifice of blade strength, which may lead to a loss of dimensional accuracy. Then the width of the cutoff abrasive blades (i.e., the width of peripheral cutting part) is preferably 0.1 to 1.5 mm. Additionally, the machining depth is preferably up to 20 mm. The feed (or forward moving) speed of the cutoff abrasive blades is preferably up to 3,000 mm/min, and more preferably 50 to 2,000 mm/min. The rotational direction of the multiple blade assembly (cutoff abrasive blades) at points of cutoff machining and the feed (or forward moving) direction of the multiple blade assembly may be either identical or opposite.

The workpiece which is intended herein to cutoff machine is a rare earth magnet block. The rare earth magnet as the workpiece is not particularly limited. Suitable rare earth magnets include sintered rare earth magnets of R—Fe—B systems wherein R is at least one rare earth element inclusive of yttrium.

Suitable sintered rare earth magnets of R—Fe—B systems are those magnets containing, in weight percent, 5 to 40% of R, 50 to 90% of Fe, and 0.2 to 8% of B, and optionally one or more additive elements selected from C, Al, Si, Ti, V, Cr, Mn, Co, Ni, Cu, Zn, Ga, Zr, Nb, Mo, Ag, Sn, Hf, Ta, and W, for the purpose of improving magnetic properties and corrosion resistance. The amounts of additive elements added are conventional, for example, up to 30 wt % of Co, and up to 8 wt % of the other elements. The additive elements, if added in extra amounts, rather adversely affect magnetic properties.

Suitable sintered rare earth magnets of R—Fe—B systems may be prepared, for example, by weighing source metal materials, melting, casting into an alloy ingot, finely pulverizing the alloy into particles with an average particle size of 1 to 20 μm, i.e., sintered R—Fe—B magnet powder, compacting the powder in a magnetic field, sintering the compact at 1,000 to 1,200° C. for 0.5 to 5 hours, and heat treating at 400 to 1,000° C.

EXAMPLE

Examples and Comparative Examples are given below for further illustrating the invention although the invention is not limited thereto.

Example 1

OD blades (cutoff abrasive blades) were fabricated by providing a doughnut-shaped disk core of tool steel SKD (JIS designation) having an outer diameter 120 mm, inner diameter 40 mm, and thickness 0.5 mm, and bonding, by the resin bonding technique, artificial diamond abrasive grains to an outer peripheral rim of the core to form an abrasive section (peripheral cutting part) containing 25% by volume of diamond grains with an average particle size of 150 μm. The axial extension of the abrasive section from the core was 0.05 mm on each side, that is, the abrasive portion had a width (in the thickness direction of the core) of 0.6 mm.

Using the OD blades, a cutting test was carried out on a workpiece which was a sintered Nd—Fe—B magnet block. The test conditions are as follows. A multiple blade assembly was manufactured by coaxially mounting 39 OD blades on a shaft at an axial spacing of 2.1 mm, with spacers interposed therebetween. The spacers each had an outer diameter 80 mm, inner diameter 40 mm, and thickness 2.1 mm. The multiple blade assembly was designed so that the magnet block was cut into magnet strips having a thickness of 2.0 mm. It is to be noted that the thickness of a magnet strip is a size of the strip in the width direction of the original block.

The multiple blade assembly consisting of 39 OD blades and 38 spacers alternately mounted on the shaft was combined with a feed nozzle as shown in FIG. 3 or 4, such that the outer peripheral portion of each OD blade was inserted into the corresponding slit in the feed nozzle as shown in FIG. 6. Specifically an outer portion of the OD blade radially extending 8 mm from the blade tip was inserted into the slit. The slit portion of the feed nozzle had a wall thickness of 2.5 mm, and the slits had a width of 0.7 mm. The OD blade extended in alignment with the slit.

The workpiece was a sintered Nd—Fe—B magnet block having a length 100 mm, width 30 mm and height 17 mm, which was polished at an accuracy of ±0.05 mm by a vertical double-disk polishing tool. By the multiple blade assembly, the magnet block was longitudinally cut into a plurality of magnet strips of 2.0 mm thick. Specifically, one magnet block was cut into 38 magnet strips because two outside strips were excluded. In this test, the magnet block was secured to a carbon base support with a wax adhesive, without using a jig.

For machining operation, a cutting fluid was fed at a flow rate of 30 L/min. First, the multiple blade assembly was positioned at a retracted position in the forward direction, i.e., outside the confines of the workpiece (so that even when the assembly was fully descended, it did not strike the workpiece), and moved downward to 18 mm below the upper surface of the workpiece. While feeding cutting fluid from the feed nozzle and rotating the OD blades at 7,000 rpm, the multiple blade assembly was moved at a speed of 20 mm/min from one end to the opposite end in the machining direction for cutoff machining the magnet block in its longitudinal direction. At the end of this stroke, the assembly was moved back to the one end side without changing its height.

Example 2

A multiple blade assembly, a cutting fluid feed nozzle, and a sintered Nd—Fe—B magnet block as in Example 1 were used and similarly set. The magnet block was secured to a carbon base support with a wax adhesive, without using a jig.

For machining operation, a cutting fluid was fed at a flow rate of 30 L/min. First, the multiple blade assembly was positioned at a retracted position in the forward direction, i.e., outside the confines of the workpiece (so that even when the assembly was fully descended, it did not strike the workpiece), and moved downward to 2 mm below the upper surface of the workpiece. While feeding cutting fluid from the feed nozzle and rotating the OD blades at 7,000 rpm, the multiple blade assembly was moved at a speed of 100 mm/min from one end to the opposite end in the machining direction for cutoff machining the magnet block in its longitudinal direction. At the end of this stroke, the assembly was moved back to the one end side without changing its height. Cutoff grooves of 2 mm deep were formed in the magnet block surface.

Next, the multiple blade assembly at the retracted position was moved 16 mm downward in the thickness direction of the workpiece. While supplying cutting fluid from the feed nozzle and rotating the OD blades at 7,000 rpm, the multiple blade assembly was moved at a speed of 20 mm/min from one end to the opposite end for cutoff machining the magnet block. At the end of this stroke, the assembly was moved back to the one end side without changing its height.

Example 3

A multiple blade assembly, a cutting fluid feed nozzle, and a sintered Nd—Fe—B magnet block as in Example 1 were used and similarly set. A jig has 39 guide grooves corresponding to the OD blades. Each groove has a length of 30 mm, a width of 0.9 mm and a depth of 19 mm. The magnet block was fixedly secured to a support by the jig so that the guide grooves were in register with the machining lines as shown in FIG. 8*b*. The upper surface of the jig (on the side of the multiple blade assembly) was coplanar with the upper surface of the workpiece or magnet block (on the side of the multiple blade assembly).

For machining operation, a cutting fluid was fed at a flow rate of 30 L/min. First, the multiple blade assembly was positioned at a retracted position, i.e., above one jig segment, and moved downward in the depth direction of the workpiece until the outer peripheral portions of the OD blades were inserted 2 mm into the guide grooves. While feeding cutting fluid from the feed nozzle and rotating the OD blades at 7,000 rpm, the multiple blade assembly was moved at a speed of 100 mm/min toward the other jig segment side in the machining direction for cutoff machining the magnet block in its longitudinal direction. At the end of this stroke, the assembly was moved back to the one jig segment side without changing its height. Cutoff grooves of 2 mm deep were formed in the magnet block surface.

Next, the multiple blade assembly was positioned above the one jig segment and moved 16 mm downward in the depth direction of the workpiece. While supplying cutting fluid from the feed nozzle and rotating the OD blades at 7,000 rpm, the multiple blade assembly was moved at a speed of 20 mm/min toward the other jig segment side for cutoff machining the magnet block. At the end of this stroke, the assembly was moved back to the one jig segment side without changing its height.

In Examples 1 to 3, magnet blocks each were cut into a plurality of magnet strips using the multiple blade assembly. The thickness of each strip at a longitudinal center was measured by a micrometer. (As noted above, the thickness of a strip is a size of the strip in the width direction of the original block.) The strip was rated "passed" when the measured thickness was within a cut size tolerance of 2.0±0.05 mm. If the measured thickness was outside the tolerance, the arrangement of OD blades was tailored by adjusting the thickness of spacers, so that the measured thickness might fall within the tolerance. If the spacer adjustment was repeated more than two times for the same OD blades, these OD blades were judged as having lost stability, and they were replaced by new OD blades. Under these conditions, 1000 magnet blocks were cut. Table 1 tabulates the results of evaluation of the machining state.

Comparative Example 1

By the same procedure as in Example 1 except for the following changes, 1000 magnet blocks were cut. The results of evaluation of the machining state are also shown in Table 1.

The cutting fluid feed nozzle was changed to a feed nozzle having only one opening with a height 3 mm and width 100 mm (opening area 300 $mm^2$). The cutting fluid was externally injected toward the OD blades through the nozzle opening.

The magnet block was secured to a carbon base support with a wax adhesive, without using a jig.

For machining operation, a cutting fluid was fed at a flow rate of 30 L/min. First, the multiple blade assembly at the retracted position (outside the workpiece in the machining direction) was moved downward such that the lower end of each OD blade was positioned 18 mm below the upper surface of the workpiece. While feeding cutting fluid from the feed nozzle and rotating the OD blades at 7,000 rpm, the multiple blade assembly was moved at a speed of 20 mm/min from one end to the opposite end in the machining direction for cutoff machining the magnet block. At the end of this stroke, the assembly was moved back to the retracted position on the one end side without changing its height.

TABLE 1

| | Number of strips | After machining 200 blocks A | 200 blocks B | 400 blocks A | 400 blocks B | 600 blocks A | 600 blocks B | 800 blocks A | 800 blocks B | 1000 blocks A | 1000 blocks B |
|---|---|---|---|---|---|---|---|---|---|---|---|
| Example 1 | 38 | 0 | 0 | 0 | 0 | 3 | 0 | 5 | 0 | 11 | 0 |
| Example 2 | 38 | 0 | 0 | 0 | 0 | 0 | 0 | 0 | 0 | 0 | 0 |
| Example 3 | 38 | 0 | 0 | 0 | 0 | 0 | 0 | 0 | 0 | 0 | 0 |
| Comparative Example 1 | 38 | 17 | 3 | 28 | 9 | 45 | 13 | 62 | 20 | 98 | 32 |

A: the number of spacer adjustments
B: the number of OD blade replacements

As is evident from Table 1, the multiple cutoff machining method of the invention ensures to continue machining at a consistent high size accuracy over a long period of time even with OD blades having a reduced width of cutting part, while minimizing the number of spacer adjustments and the number of OD blade replacements. This leads to an improved productivity.

In Examples 2 and 3, magnet strips cut from the 1000-th magnet blocks were measured for thickness. The strips of Example 2 showed a thickness variation of 93 μm, whereas the strips of Example 3 showed a thickness variation of 51 μm, demonstrating a higher accuracy of machining.

Example 4

OD blades (cutoff abrasive blades) were fabricated by providing a doughnut-shaped disk core of cemented carbide (consisting of WC 90 wt % and Co 10 wt %) having an outer diameter 120 mm, inner diameter 40 mm, and thickness 0.35 mm, and bonding, by the resin bonding technique, artificial diamond abrasive grains to an outer peripheral rim of the core to form an abrasive section (peripheral cutting part) containing 25% by volume of diamond grains with an average particle size of 150 μm. The axial extension of the abrasive section from the core was 0.05 mm on each side, that is, the abrasive section had a width (in the thickness direction of the core) of 0.45 mm.

Using the OD blades, a cutting test was carried out on a workpiece which was a sintered Nd—Fe—B magnet block. The test conditions are as follows. A multiple blade assembly was manufactured by coaxially mounting 41 OD blades on a shaft at an axial spacing of 2.1 mm, with spacers interposed therebetween. The spacers each had an outer diameter 80 mm, inner diameter 40 mm, and thickness 2.1 mm. The multiple blade assembly was designed so that the magnet block was cut into magnet strips having a thickness of 2.0 mm.

The multiple blade assembly consisting of 41 OD blades and 40 spacers alternately mounted on the shaft was combined with a feed nozzle as shown in FIG. 3 or 4, such that the outer peripheral portion of each OD blade was inserted into the corresponding slit in the feed nozzle as shown in FIG. 6. Specifically an outer portion of the OD blade radially extending 8 mm from the blade tip was inserted into the slit. The slit portion of the feed nozzle had a wall thickness of 2.5 mm, and the slits had a width of 0.6 mm. The OD blade extended in alignment with the slit.

The workpiece was a sintered Nd—Fe—B magnet block having a length 100 mm, width 30 mm and height 17 mm, which was polished at an accuracy of ±0.05 mm by a vertical double-disk polishing tool. By the multiple blade assembly, the magnet block was longitudinally cut into a plurality of magnet strips of 2.0 mm thick. Specifically, one magnet block was cut into 40 magnet strips because two outside strips were excluded.

A jig has 41 guide grooves corresponding to the OD blades. Each groove has a length of 30 mm, a width of 0.9 mm and a depth of 19 mm. The magnet block was fixedly secured to a support by the jig so that the guide grooves are in register with the machining lines as shown in FIG. 8*b*. The upper surface of the jig (on the side of the multiple blade assembly) was coplanar with the upper surface of the workpiece or magnet block (on the side of the multiple blade assembly).

For machining operation, a cutting fluid was fed at a flow rate of 30 L/min. First, the multiple blade assembly at the retracted position, i.e., above one jig segment, was moved downward in the depth direction of the workpiece until the outer peripheral portions of the OD blades were inserted 2 mm into the guide grooves. While feeding cutting fluid from the feed nozzle and rotating the OD blades at 7,000 rpm, the multiple blade assembly was moved at a speed of 100 mm/min toward the other jig segment side in the machining direction for cutoff machining the magnet block. At the end of this stroke, the assembly was moved back to the one jig segment side without changing its height. Cutoff grooves of 2 mm deep were formed in the magnet block surface.

Next, the multiple blade assembly at the retracted position above the one jig segment was moved 16 mm downward in the depth direction of the workpiece. While supplying cutting fluid from the feed nozzle and rotating the OD blades at 7,000 rpm, the multiple blade assembly was moved at a speed of 20 mm/min toward the other jig segment side for cutoff machining the magnet block. At the end of this stroke, the assembly was moved back to the one jig segment side without changing its height.

After magnet blocks were cut into a plurality of magnet strips in this way, the thickness of each strip at a longitudinal center was measured by a micrometer. The strip was rated "passed" when the measured thickness was within a cut size tolerance of 2.0±0.05 mm. If the measured thickness was outside the tolerance, the arrangement of OD blades was tailored by adjusting the thickness of spacers, so that the measured thickness might fall within the tolerance. If the spacer adjustment was repeated more than two times for the same OD blades, these OD blades were judged as having lost stability, and they were replaced by new OD blades. Under these conditions, 1000 magnet blocks were cut. Table 2 tabulates the results of evaluation of the machining state.

TABLE 2

| | Number of strips | After machining 200 blocks A | 200 blocks B | 400 blocks A | 400 blocks B | 600 blocks A | 600 blocks B | 800 blocks A | 800 blocks B | 1000 blocks A | 1000 blocks B |
|---|---|---|---|---|---|---|---|---|---|---|---|
| Example 4 | 40 | 0 | 0 | 0 | 0 | 0 | 0 | 0 | 0 | 0 | 0 |

A: the number of spacer adjustments
B: the number of OD blade replacements

As is evident from Table 2, the multiple cutoff machining method of the invention ensures to continue machining at a consistent high size accuracy over a long period of time even with OD blades of cemented carbide core having an even reduced width of cutting part, while minimizing the number of spacer adjustments and the number of OD blade replacements. This leads to an improved productivity and an increased number of strips cut at a time.

Example 5

OD blades (cutoff abrasive blades) were fabricated by providing a doughnut-shaped disk core of cemented carbide (consisting of WC 90 wt % and Co 10 wt %) having an outer diameter 130 mm, inner diameter 40 mm, and thickness 0.5 mm, and bonding, by the resin bonding technique, artificial diamond abrasive grains to an outer peripheral rim of the core to form an abrasive section (peripheral cutting part) containing 25% by volume of diamond grains with an average particle size of 150 μm. The axial extension of the abrasive section from the core was 0.05 mm on each side, that is, the abrasive section had a width (in the thickness direction of the core) of 0.6 mm.

Using the OD blades, a cutting test was carried out on a workpiece which was a sintered Nd—Fe—B magnet block. The test conditions are as follows. A multiple blade assembly was manufactured by coaxially mounting 14 OD blades on a shaft at an axial spacing of 3.1 mm, with spacers interposed therebetween. The spacers each had an outer diameter 70 mm, inner diameter 40 mm, and thickness 3.1 mm. The multiple blade assembly was designed so that the magnet block was cut into magnet strips having a thickness of 3.0 mm.

The multiple blade assembly consisting of 14 OD blades and 13 spacers alternately mounted on the shaft was combined with a feed nozzle as shown in FIG. 3 or 4, such that the outer peripheral portion of each OD blade was inserted into the corresponding slit in the feed nozzle as shown in FIG. 6. Specifically an outer portion of the OD blade radially extending 8 mm from the blade tip was inserted into the slit. The slit portion of the feed nozzle had a wall thickness of 2.5 mm, and the slits had a width of 0.8 mm. The OD blade extended in alignment with the slit.

The workpiece was a sintered Nd—Fe—B magnet block having a length 47 mm, width 30 mm and height 20 mm, which was polished at an accuracy of 10.05 mm by a vertical double-disk polishing tool. By the multiple blade assembly, the magnet block was longitudinally cut into a plurality of magnet strips of 3.0 mm thick. Specifically, one magnet block was cut into 13 magnet strips because two outside strips were excluded.

A jig has 14 guide grooves corresponding to the OD blades. Each groove has a length of 50 mm, a width of 0.8 mm and a depth of 22 mm. The magnet block was fixedly secured to a support by the jig so that the guide grooves are in register with the machining lines as shown in FIG. 8*b*. The upper surface of the jig (on the side of multiple blade assembly) was coplanar with the upper surface of the workpiece or magnet block (on the side of multiple blade assembly).

For machining operation, a cutting fluid was fed at a flow rate of 30 L/min. First, the multiple blade assembly at the retracted position above one jig segment was moved downward in the depth direction of the workpiece until the outer peripheral portions of the OD blades were inserted 7 mm into the guide grooves. While feeding cutting fluid from the feed nozzle and rotating the OD blades at 9,000 rpm (61 m/sec), the multiple blade assembly was moved at a speed of 70 mm/min toward the other jig segment side in the machining to direction for cutoff machining the magnet block. At the end of this stroke, the assembly was moved back to the one jig segment side without changing its height. Cutoff grooves of 7 mm deep were formed in the magnet block surface.

Next, the multiple blade assembly at the retracted position above the one jig segment was moved 14 mm downward in the depth direction of the workpiece. While supplying cutting fluid from the feed nozzle and rotating the OD blades at 9,000 rpm, the multiple blade assembly was moved at a speed of 20 mm/min toward the other jig segment side for cutoff machining the magnet block. At the end of this stroke, the assembly was moved back to the one end side without changing its height.

During the machining operation of the magnet block, a compact cutting dynamometer 9254 (Kistler) was located below the magnet block for measuring the stress applied to the magnet block. The stress along the moving direction of the multiple blade assembly during machining to form initial guide grooves was 75 N in the forward moving direction of the blade assembly, and the stress along the moving direction of the multiple blade assembly during subsequent machining was 140 N in the forward moving direction of the blade assembly.

Figure 10A:
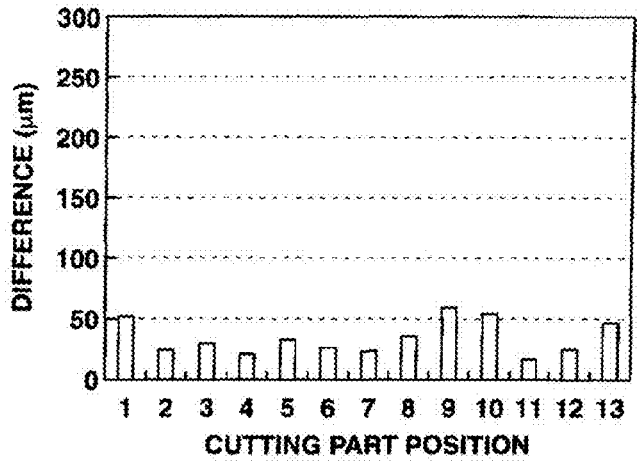
FIG. 10 graphically plots the accuracy of thickness of magnet pieces cutoff in Examples 5, 6 and Comparative Example 2.
Figure 10B:
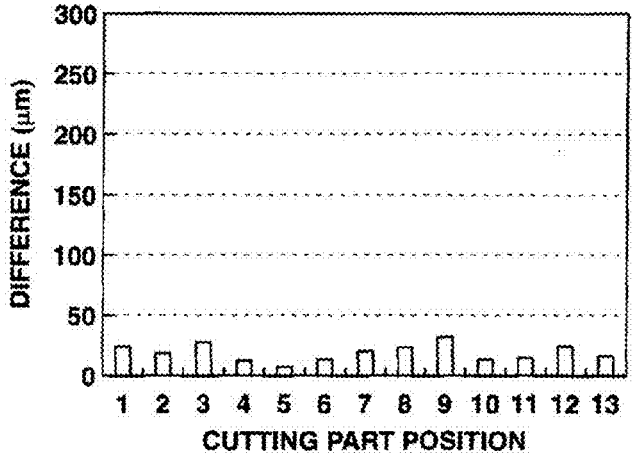
Figure 10C:
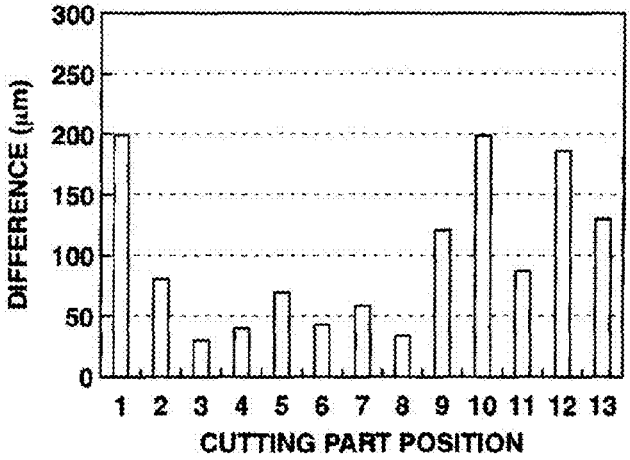
Figure 10D:
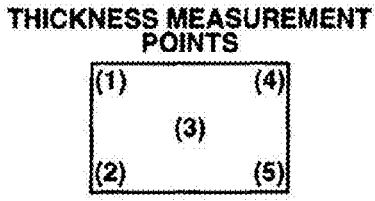

After a magnet block was cut into a plurality of magnet strips using the OD blades, the thickness of each strip at 5 points (i.e., center and four corners of cut section as shown in FIG. 10*d*) was measured by a micrometer. A difference between the maximum and minimum thicknesses was computed, with the results shown in FIG. 10*a*.

Example 6

A sintered Nd—Fe—B magnet block was machined as in Example 5 except for the following changes.

For machining operation, a cutting fluid was fed at a flow rate of 30 L/min. First, the multiple blade assembly at the retracted position above one jig segment was moved downward in the depth direction of the workpiece until the outer peripheral portions of the OD blades were inserted 0.75 mm into the guide grooves. While feeding cutting fluid from the feed nozzle and rotating the OD blades at 9,000 rpm (61 m/sec), the multiple blade assembly was moved at a speed of 1500 mm/min toward the other jig segment side in the machining direction for cutoff machining the magnet block. At the end of this stroke, the assembly was moved back to the one end side without changing its height. Cutoff grooves of 0.75 mm deep were formed in the magnet block surface.

Next, the multiple blade assembly at the retracted position above the one jig segment was moved 0.75 mm downward in the depth direction of the workpiece. While supplying cutting fluid from the feed nozzle and rotating the OD blades at 9,000 rpm, the multiple blade assembly was moved at a speed of 1500 mm/min toward the other jig segment side for cutoff machining the magnet block. At the end of this stroke, the assembly was moved back to the one jig segment side without changing its height. The downward movement and transverse movement (for machining) was repeated 26 cycles until the magnet block was cutoff.

Figure 11A:
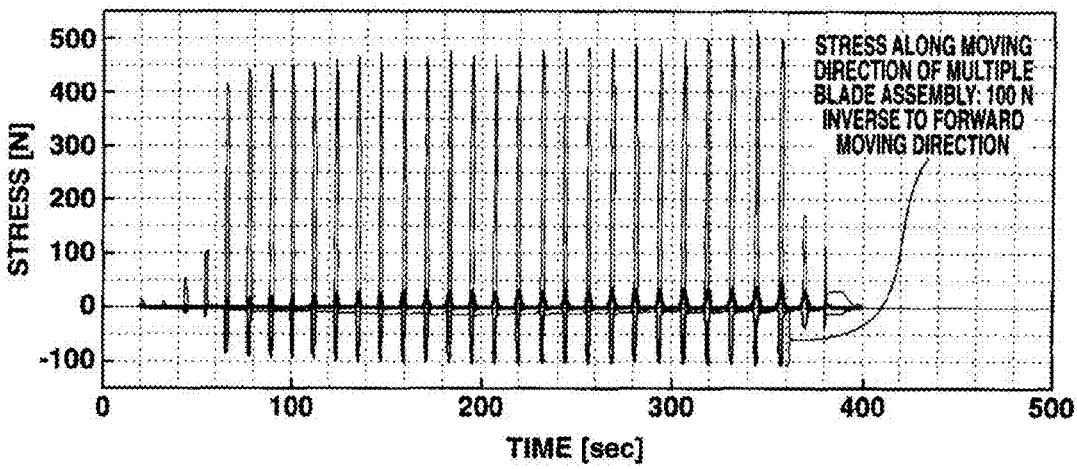
FIG. 11 graphically shows the measurement results of machining stress in Example 6 and Comparative Example 2.

During the machining operation of the magnet block, a compact cutting dynamometer 9254 (Kistler) was located below the magnet block for measuring the stress applied to the magnet block. The results are shown in FIG. 11*a*. In the graph of FIG. 11*a* depicting the stress along the moving direction of the multiple blade assembly, the stresses in a direction perpendicular to the moving direction and in the axial direction of the rotating shaft of the blades are also depicted. The stress along the moving direction of the multiple blade assembly during machining to form initial guide grooves and the stresses along the moving direction of the multiple blade assembly during subsequent machining steps were all 100 N in a direction opposite to the forward moving direction of the blade assembly.

After a magnet block was cut into a plurality of magnet strips using the OD blades, the thickness of each strip at 5 points (i.e., center and four corners of cut section as shown in FIG. 10*d*) was measured by a micrometer. A difference between the maximum and minimum thicknesses was computed, with the results shown in FIG. 10*b*.

Comparative Example 2

A sintered Nd—Fe—B magnet block was machined as in Example 5 except for the following changes.

The cutting fluid feed nozzle was changed to a feed nozzle having only one opening with a height 3 mm and width 100 mm (opening area 300 $mm^2$). The cutting fluid was externally injected toward the OD blades through the nozzle opening.

The magnet block was secured to a carbon base support with a wax adhesive, without using a jig.

For machining operation, a cutting fluid was fed at a flow rate of 30 L/min. First, the multiple blade assembly retracted at one end in the machining direction was moved downward such that the lower ends of the OD blades were positioned 21 mm below the upper surface of the workpiece. While feeding cutting fluid from the feed nozzle and rotating the OD blades at 9,000 rpm, the multiple blade assembly was moved at a speed of 20 mm/min from one end to the opposite end of the magnet block in the machining direction for cutoff machining the magnet block. At the end of this stroke, the assembly was moved back to the one end side without changing its height.

Figure 11B:
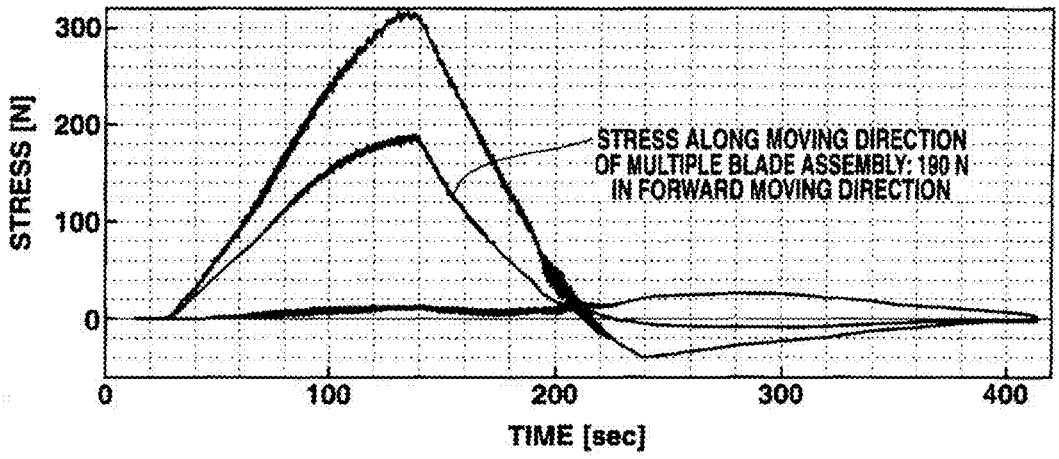

During the machining operation of the magnet block, a compact cutting dynamometer 9254 (Kistler) was located below the magnet block for measuring the stress applied to the magnet block. The results are shown in FIG. 11*b*. In the graph of FIG. 11*b* depicting the stress along the moving direction of the multiple blade assembly, the stresses in a direction perpendicular to the moving direction and in the axial direction of the rotating shaft of the blades are also depicted. The stress along the moving direction of the multiple blade assembly during machining was 190 N in the forward moving direction of the blade assembly.

After a magnet block was cut into a plurality of magnet strips using the OD blades, the thickness of each strip at 5 points (i.e., center and four corners of cut section as shown in FIG. 10*d*) was measured by a micrometer. A difference between the maximum and minimum thicknesses was computed, with the results shown in FIG. 10*c*.

As seen from FIG. 10, the multiple cutoff machining method of the invention achieves a significantly improved accuracy of cutoff machining. A further improvement in accuracy is achievable by effecting machining operation such that a stress is applied in a direction opposite to the forward moving direction of the multiple blade assembly.

Japanese Patent Application Nos. 2008-284566, 2008-284644 and 2008-284661 are incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A method for multiple cutoff machining a rare earth magnet block, said method comprising the steps of:

providing a multiple blade assembly comprising a plurality of cutoff abrasive blades coaxially mounted on a rotating shaft at axially spaced apart positions, each said blade comprising a core in the form of a thin disk or thin doughnut disk and a peripheral cutting part on an outer peripheral rim of the core, providing a cutting fluid feed nozzle having a cutting fluid inlet at one end and a plurality of slits formed at another end and corresponding to the plurality of cutoff abrasive blades such that an outer peripheral portion of each cutoff abrasive blade may be inserted in the corresponding slit, combining said feed nozzle with said multiple blade assembly such that the outer peripheral portion of each cutoff abrasive blade is inserted into the corresponding slit in said feed nozzle, feeding a cutting fluid into said feed nozzle through the inlet and injecting the cutting fluid through the slits, and rotating the cutoff abrasive blades to cutoff machine the magnet block while the slits in said feed nozzle into which the outer peripheral portions of cutoff abrasive blades are inserted serve to restrict any axial run-out of the cutoff abrasive blades during rotation, wherein the cutting fluid reaching the slits and coming in contact with the outer peripheral portion of each cutoff abrasive blade is entrained on surfaces of the cutoff abrasive blade being rotated and transported toward the peripheral cutting part of the cutoff abrasive blade by the centrifugal force of rotation, whereby the cutting fluid is delivered to points of cutoff machining on the magnet block during multiple cutoff machining; and a jig consisting of a pair of jig segments for clamping the magnet block in the machining direction are provided to secure the magnet block, one or both of the jig segments are provided on their surfaces with a plurality of guide grooves corresponding to the plurality of cutoff abrasive blades such that the outer peripheral portion of each cutoff abrasive blade may be inserted into the corresponding guide groove, the cutoff abrasive blades are rotated while the guide grooves into which the outer peripheral portions of cutoff abrasive blades are inserted serves to restrict any axial run-out of the cutoff abrasive blades during rotation, the cutting fluid flowing in the guide groove including the cutting fluid flowing from each slit in said feed nozzle and across the surfaces of the cutoff abrasive blade is entrained on surfaces of the cutoff abrasive blade being rotated whereby the cutting fluid is delivered to points of cutoff machining on the magnet block during multiple cutoff machining.

2. The method of claim 1 wherein at an initial stage of cutoff machining of the rare earth magnet block, either one or both of said multiple blade assembly and the magnet block are relatively moved from one end to another end of the magnet block in its longitudinal direction, thereby machining the surface of magnet block to form cutoff grooves of a predetermined depth in the magnet block surface, the cutoff abrasive blades are further rotated to further cutoff machine the magnet block while the cutoff grooves into which the outer peripheral portions of the cutoff abrasive blades are inserted serve to restrict any axial run-out of the cutoff abrasive blades, the cutting fluid flowing in the cutoff groove including the cutting fluid flowing from each slit in said feed nozzle and across the surfaces of the cutoff abrasive blade is entrained on surfaces of the cutoff abrasive blade being rotated whereby the cutting fluid is delivered to points of cutoff machining on the magnet block during multiple cutoff machining.

3. The method of claim 2 wherein after the cutoff grooves are formed, said multiple blade assembly is retracted outside the magnet block and either one or both of said multiple blade assembly and the magnet block are relatively moved so as to bring them closer in the depth direction of the cutoff grooves in the magnet block, while the outer peripheral portion of each cutoff abrasive blade is inserted into the cutoff groove in the magnetic block, either one or both of the multiple blade assembly and the magnet block are relatively moved from one end to another end of the magnet block in its longitudinal direction for machining the magnet block, which machining operation is repeated one or more times until the magnet block is cut throughout its thickness.

4. The method of claim 3 wherein the depth of the cutoff grooves and the distance of movement in the depth direction after formation of the cutoff grooves are both from 0.1 mm to 20 mm.

5. The method of claim 3 wherein a machining stress along the moving direction during the machining operation is applied to the magnet block being machined in a direction opposite to the moving direction of the multiple blade assembly relative to the magnet block.

6. The method of claim 2 wherein the peripheral cutting part of the cutoff abrasive blade has a width W, and the slit in the feed nozzle has a width of from more than W mm to (W+6) mm.

7. The method of claim 1 wherein the guide grooves in the jig segment extend a length of 1 mm to 100 mm from the magnet block which is secured by the jig.

8. The method of claim 1 wherein at an initial stage of cutoff machining of the rare earth magnet block, either one or both of said multiple blade assembly and the magnet block are relatively moved from one end to another end of the magnet block in its longitudinal direction, thereby machining the surface of magnet block to form cutoff grooves of a predetermined depth in the magnet block surface, with the proviso that during machining at the opposite ends in the machining direction, the outer peripheral portions of cutoff abrasive blades are inserted into the corresponding guide grooves in the jig segments, the cutoff grooves into which the outer peripheral portions of the cutoff abrasive blades are inserted serve to restrict any axial run-out of the cutoff abrasive blades, the cutting fluid flowing in the cutoff groove including the cutting fluid flowing from each slit in said feed nozzle and across the surfaces of the cutoff abrasive blade is entrained on surfaces of the cutoff abrasive blade being rotated whereby the cutting fluid is delivered to points of cutoff machining on the magnet block during multiple cutoff machining.

9. The method of claim 1 wherein after the cutoff grooves are formed, said multiple blade assembly is retracted outside the magnet block and either one or both of said multiple blade assembly and the magnet block are relatively moved so as to bring them closer in the depth direction of the cutoff grooves in the magnet block, while the outer peripheral portion of each cutoff abrasive blade is inserted into the cutoff groove in the magnetic block and/or the guide groove in the jig segment, either one or both of the multiple blade assembly and the magnet block are relatively moved from one end to another end of the rare earth magnet block in its longitudinal direction for machining the magnet block, which machining operation is repeated one or more times until the magnet block is cut throughout its thickness.

10. The method of claim 9 wherein the depth of the cutoff grooves and the distance of movement in the depth direction after formation of the cutoff grooves are both from 0.1 mm to 20 mm.

11. The method of claim 8 wherein a machining stress along the moving direction during the machining operation is applied to the magnet block being machined in a direction opposite to the moving direction of the multiple blade assembly relative to the magnet block.

12. The method of claim 1 wherein the peripheral cutting part of the cutoff abrasive blade has a width W, and the slit in the feed nozzle and the guide groove in the jig segment both have a width of from more than W mm to (W+6) mm.

* * * * *